US007696952B2

(12) United States Patent
Kimura et al.

(10) Patent No.: US 7,696,952 B2
(45) Date of Patent: Apr. 13, 2010

(54) DISPLAY DEVICE AND METHOD OF DRIVING THE SAME

(75) Inventors: Hajime Kimura, Kanagawa (JP); Shunpei Yamazaki, Tokyo (JP)

(73) Assignee: Semiconductor Energy Laboratory Co., Ltd, Atsugi-shi, Kanagawa-ken ( * ) Notice: Subject to any disclaimer, the term of this patent is extended or adjusted under 35 U.S.C. 154(b) by 664 days.

(21) Appl. No.: 10/637,002

(22) Filed: Aug. 8, 2003

(65) Prior Publication Data

US 2004/0095305 A1 May 20, 2004

(30) Foreign Application Priority Data

Aug. 9, 2002 (JP) ..... 2002-232775

(51) Int. Cl.
*G09G 5/00* (2006.01)

(52) U.S. Cl. ..... 345/1.1; 345/90; 345/98

(58) Field of Classification Search ..... 345/1.1, 345/4, 5, 98–100, 30, 33, 36–39, 90
See application file for complete search history.

(56) References Cited

U.S. PATENT DOCUMENTS 4,651,146 A 3/1987 Lucash et al.
4,653,020 A 3/1987 Cheselka et al.
4,796,089 A * 1/1989 Imai et al. ..... 348/565
4,890,257 A 12/1989 Anthias et al.
5,712,652 A * 1/1998 Sato et al. ..... 345/90
5,914,728 A 6/1999 Yamagishi et al.
5,945,972 A 8/1999 Okumura et al.
6,266,038 B1 * 7/2001 Yoshida et al. ..... 345/92

(Continued)

FOREIGN PATENT DOCUMENTS

EP 1 111 574 6/2001

(Continued)

OTHER PUBLICATIONS

European Partial Search Report dated Dec. 13, 2005 for Application No. 03018140.8.

(Continued)

*Primary Examiner*—Amr Awad
*Assistant Examiner*—Stephen G Sherman
(74) *Attorney, Agent, or Firm*—Eric J. Robinson; Robinson Intellectual Property Law Office, P.C.

(57) ABSTRACT

In a multi-window display device, the following has been merely performed: before data for plural screens is inputted to a display, video signals themselves are subjected to signal processing, and the processed video signals are inputted to the display, whereby display is performed. Therefore, a circuit for performing signal processing, for example, an IC has a complicated structure since video signals for plural screens are stored in a memory. There is provided a pixel structure in which: signal lines for plural screens are arranged; and one of the signal lines is selected to supply a video signal to a display element. For example, in the case of performing display of two screens, there is provided a pixel structure in which: two signal lines, which are inputted with respective video signals for a first screen and a second screen, are arranged; and one of the signal lines is selected to supply a video signal from the selected signal line to a display element.

8 Claims, 15 Drawing Sheets

U.S. PATENT DOCUMENTS

| | | | | |
|---|---|---|---|---|
| 6,295,054 | B1 * | 9/2001 | McKnight | 345/205 |
| 6,476,785 | B1 * | 11/2002 | Pathak et al. | 345/90 |
| 6,545,655 | B1 * | 4/2003 | Fujikawa | 345/87 |
| 6,583,576 | B2 * | 6/2003 | Koyama | 315/169.2 |
| 7,173,589 | B2 | 2/2007 | Senda et al. | |
| 7,180,496 | B2 | 2/2007 | Koyama et al. | |
| 2002/0021295 | A1 | 2/2002 | Koyama et al. | |
| 2002/0041266 | A1 * | 4/2002 | Koyama et al. | 345/87 |
| 2002/0047555 | A1 | 4/2002 | Inukai | |
| 2003/0090447 | A1 | 5/2003 | Kimura | |
| 2007/0132691 | A1 | 6/2007 | Koyama et al. | |

FOREIGN PATENT DOCUMENTS

| | | | |
|---|---|---|---|
| EP | 1246159 | A | 10/2002 |
| JP | 58-143389 | | 8/1983 |
| JP | 05-242232 | | 9/1993 |
| JP | 2002-132234 | A | 5/2002 |
| JP | 2002-297082 | A | 10/2002 |
| WO | WO 03/027997 | | 4/2003 |

OTHER PUBLICATIONS

European Search Report dated Feb. 22, 2006 for Application No. 03018140.8.

* cited by examiner

DISPLAY DEVICE AND METHOD OF DRIVING THE SAME

BACKGROUND OF THE INVENTION

1. Field of the Invention

The present invention relates to a multi-window display device, which is also an EL display device, a liquid crystal display device, or other display devices and in which plural screens also called multi windows are displayed on a display screen, and relates to a method of driving such a display device.

2. Description of the Related Art

In recent years, there have been conducted researches on a multi-window display device in which two or more images (including a static image and a dynamic image) are simultaneously displayed on a display screen. The multi-window display device is a very convenient display device because a screen for explanation of operation and a screen for performing the operation are displayed at one time or because a navigation screen and a screen for displaying a rear portion of an automobile are displayed at one time in a car navigation system.

FIG. 11 shows a conventional multi-window display device. In the multi-window display device, since plural screens (for example, two screens) are simultaneously displayed on a display screen, a first video signal and a second video signal corresponding to two pieces of image information are inputted, and signal processing is performed in an IC (integrated circuit) 11. Conducted in the IC 11 is the signal processing for synthesizing the two pieces of image information (each including information on the relative position and the size) for the two screens. The above-described video signal synthesized in the IC 11 is once held in a memory 12, and then is inputted to a signal line driver circuit 13.

Then, a scanning line driver circuit 14 sequentially selects pixels in a pixel portion 15, and a first screen 16 and a second screen 17 are displayed in accordance with the video signals supplied from the signal line driver circuit 13.

That is, from the viewpoint of the display screen, the screens are displayed simply in accordance with the input video signals irrespective of whether the multi-window screens are displayed or not.

An example of the above-described operation method is described in JP 05-242232 A, in which a signal from a PC display control means and a signal from the outside are synthesized by a display synthesizing means to thereby be input to a display means.

Further, also described in JP 05-242232 A is a method of arbitrary displaying the relative position and the size of each screen, in which a display reading control means and also a display position/size control means vary an increasing rate of a row address in reading, and thin down a row read out from a display memory to thereby control the size in a vertical direction.

In the above-described displaying method, prior to inputting to the display, the following is merely carried out: signal processing is conducted to the video signal itself; the processed video signal is inputted to the display; and then, display is performed. Therefore, a circuit for conducting signal processing, for example, an integrated circuit becomes complicated in order to store in a memory video signals corresponding to plural screens.

Further, even the information on the position and size of each of the first screen and the second screen is stored in the memory. As a result, a load is further placed on the integrated circuit.

SUMMARY OF THE INVENTION

The present invention has been made in view of the above, and therefore has an object to provide a multi-window display device in which a load is not placed on an integrated circuit for conducting signal processing. Further, the present invention has another object to provide a method of controlling a position and size of each of a first screen and a second screen.

The present invention is characterized by a pixel structure in which: signal lines corresponding to plural screens are arranged; and any one of the signal lines is selected to supply a video signal to a display element. For example, in the case of performing display of two screens, there is provided a pixel structure in which: two signal lines, to which video signals for a first screen and a second screen are respectively input, are provided; and one of the signal lines is selected to supply the video signal from the selected signal line to a display element.

Selection can be performed concerning from which signal line a video signal is inputted to a pixel among the plural signal lines. Therefore, even if a certain scanning line is selected, signals are not rewritten in all the pixels in the row, and only the signal from the selected signal line is rewritten in the corresponding pixel.

As a result, writing of video signals (writing of a video signal for a first screen and writing of a video signal for a second screen in the case of, for example, two-screen display) can be performed independently on a signal-by-signal basis. Thus, writing can be performed without mutual influence between the screens.

The pixel structure according to the present invention negates the need for signal processing for synthesizing video signals for plural screens. Thus, multi-window display can be performed without putting a load on an IC (integrated circuit) and the like. Further, with the pixel structure according to the present invention, only one of signal lines for plural screens is selected in relation to a certain scanning line. Thus, even if video signals are supplied from plural signal lines to a display element, the video signal is not input from the selected signal line to the display element. Accordingly, malfunction and misregistration can be reduced.

Further, according to the present invention, it is characterized in that a circuit for arbitrarily compressing a screen (hereinafter, referred to as screen compression circuit) is provided as means for arbitrarily displaying the relative position and the size of each screen. The screen compression circuit includes a first memory for storing image data before compression and a second memory for storing image data after compression. First, image data of a row for the screen to be downsized (compressed) is inputted and stored in the first memory. Thereafter, the image data obtained by thinning down the above data in accordance with a target size after compression is inputted and stored in the second memory. Then, the image data is inputted to a pixel portion from the second memory, and the image compressed in a lateral direction is displayed. At this time, a scanning line driver circuit is controlled so as to select a scanning line in accordance with a display position. From the above, display can be performed with the arbitrary position and size.

With the above-described structure, the load on an integrated circuit can be reduced since the video signals for plural screens do not need to be stored in the memory. Further, the image data on the relative position and the size of each screen can be arbitrarily displayed without being stored in the memory for signal processing.

In the present invention, any kind of transistors may be used for in a pixel and a driver circuit. For example, a thin film transistor (TFT) that uses a non-single crystal semiconductor film typified by amorphous silicon or polycrystalline silicon, a MOS transistor formed by using a semiconductor substrate or a SOI substrate, a junction transistor, a transistor that uses an organic semiconductor or a carbon nano-tube, and other transistors can be adopted. Also, there is no limitation placed on the kind of substrates on which transistors are arranged, and the transistors can be arranged on a single crystal substrate, a SOI substrate, a glass substrate, or the like.

In the present invention, it is sufficient that being in connection indicates being in electrical connection, and a different element, a switch, or the like may be arranged between connections.

Examples of display elements arranged in pixels include elements used in a FED (field emission display) and elements used in a DMD (digital mirror device) besides EL elements.

DETAILED DESCRIPTION OF THE PREFERRED EMBODIMENTS

In the following embodiment modes, description will be made with reference to the accompanying drawings. Note that description will be made with a multi-window display device having two screens in the following embodiment modes, but a multi-window display device having three or more screens can also be implemented.

Embodiment Mode 1

Figure 1A:
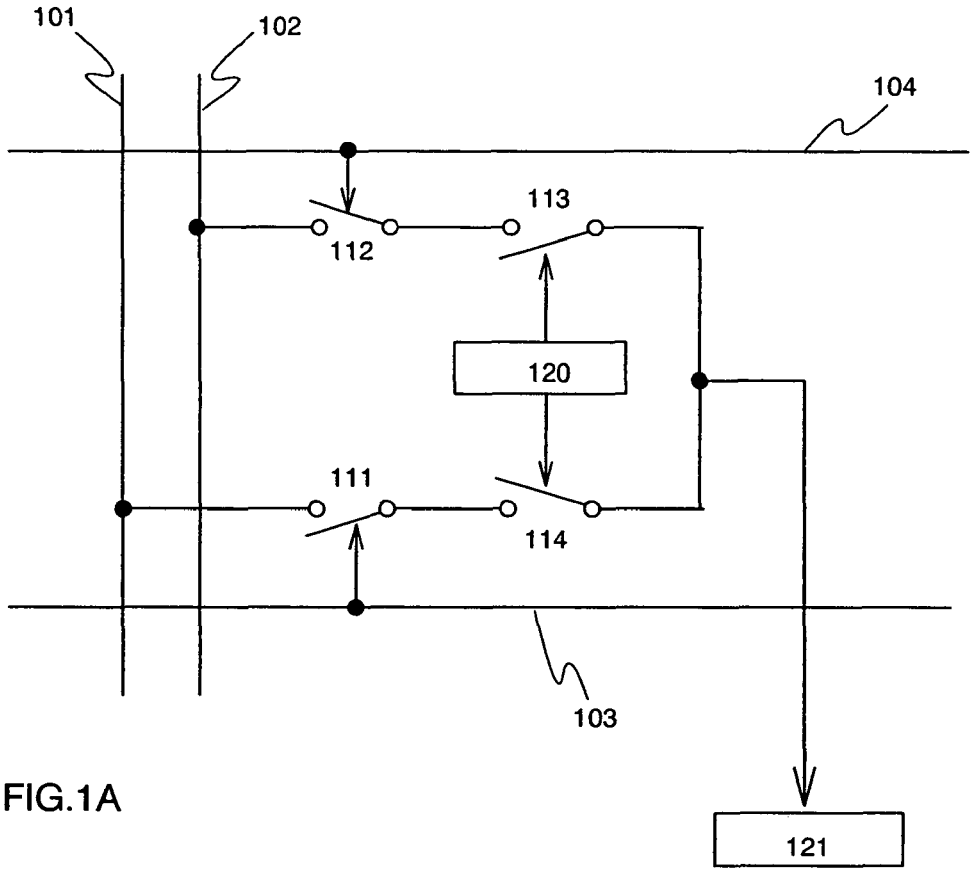
FIGS. 1A and 1B are diagrams showing pixel structures of a display device according to the present invention.

In this Embodiment Mode, a structure of a pixel portion and a screen compression circuit are described referring to FIG. 1A.

FIG. 1A shows a pixel structure, which includes: a first signal line (a signal line for a first screen) 101; a first scanning line (a scanning line for the first screen) 103; a first switch 111 in which on/off is controlled based on the information of the first signal line 101 and the first scanning line 103; a second signal line (a signal line for a second screen) 102 and a second scanning line (a scanning line for the second screen) 104; a second switch 112 in which on/off is controlled based on the information of the second signal line 102 and the second scanning line 104; a third switch 113 and a fourth switch 114 in which on/off are controlled based on the information of a memory 120 that are connected to the first switch 111 and the second switch 112 respectively; and a display element 121 connected to the third switch 113 and the fourth switch 114.

First, image data on the position and the size of the first screen and the second screen are inputted into all the pixels. Then, the memory 120 selects either of the switch 113 or the switch 114 based on the image data. Subsequently, a video signal is inputted into the display element 121 from one selected from the signal line 101 and the signal line 102; display is performed accordingly. An image is displayed based on the signal. Namely, information of the selected signal line is exclusively supplied to a light emitting element. Therefore, even though plural signal lines and plural scanning lines are selected, plural video signals are not inputted into a display element, where a multi-window display is performed.

Note that, in this Embodiment Mode, a display element 121 is formed of a liquid crystal element or a light emitting element and comprises a circuit which has a function switch such as a transistor, capacitance, or the combination thereof. The capacitance can be omitted by using the gate capacitance of the transistor.

Further, the memory may be formed of a transistor with different polarity, a capacitor element, SRAM (Static Random Access Memory), DRAM (Dynamic Random Memory) or other circuits.

Figure 1B:
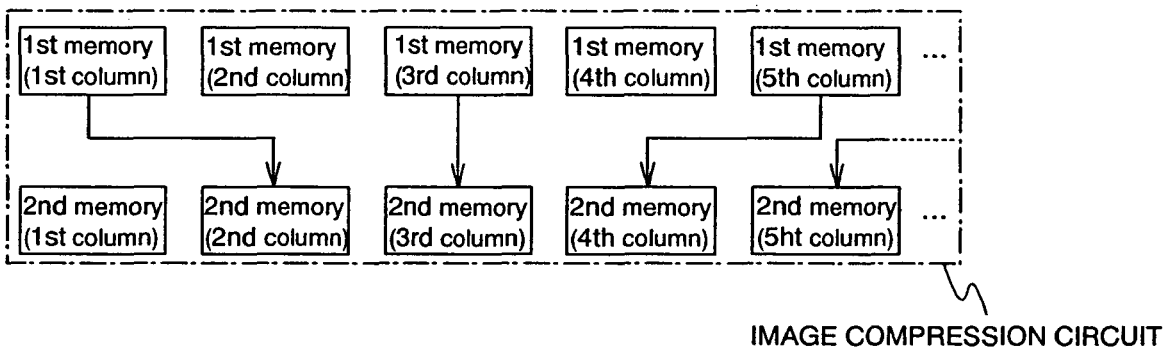

Next, the operation of a screen compression circuit is shown in FIG. 1B. Note that, the screen compression circuit shown shall display two screens, and a screen to be compressed shall be a second screen. First, a screen compression circuit is a circuit provided with a first memory and a second memory corresponding to a column number of a pixel portion, and a row of the uncompressed image data is inputted to the first memory and the data is stored therein. Subsequently, the image data is inputted from the alternate first memory into the second memory. Thus, a compressed second screen is displayed. The first memory and the second screen are provided with respective switches therebetween. The first memory is selected alternately from the first column; the second memory is selected sequentially from the second column; and the compressed image data is inputted to the pixel portion, and the second screen is displayed from the second column of the pixel portion where the apparent size of the row is compressed into half.

Note that, spaces of first memories are not limited to the alternation, and may be set in accordance with the size of the second screen, which is to be compressed. Further, with the screen compressing circuit of this Embodiment Mode, the size and the position of the first screen may be decided, and the size and the position of plural screens may be also decided.

In the structure described above, switches are disposed on the respective parts; however, the location is not limited to the parts mentioned above. The switches can be disposed on any position where they operate properly.

A switch can be either an electric switch or a mechanical switch. Namely, a switch may be whatever can regulate an electric current. For example, either of a transistor and a diode or a logic circuit including a combination of those may be applied.

When using a transistor as a switch, the polarity (conductivity type) is not particularly limited because the transistor merely functions as a switch. However, when it is preferable that off-state current be low, a transistor provided with a LDD region may be employed. When a transistor is used as a switch, it is desirable that an n-channel transistor be employed in the case where a transistor operates on condition that the potential at the source terminal thereof is low as the lower side (Vss, Vgnd, 0V, or the like), and a p-channel transistor be employed in the case where the transistor operates on condition that the potential at the source terminal thereof is high as the higher side (Vdd or the like). Because the transistor can easily operates as a switch when the absolute value of gate-source voltage increases. Note that, CMOS switch may be applied by using both an n-channel transistor and a p-channel transistor.

With a screen compression circuit described above, it is not necessary to store information of the position and the size of a first screen and a second screen in a memory. Further, the second screen can be displayed in an arbitrary shape not exclusive to a rectangle shape in any position on the first screen.

Figure 2:
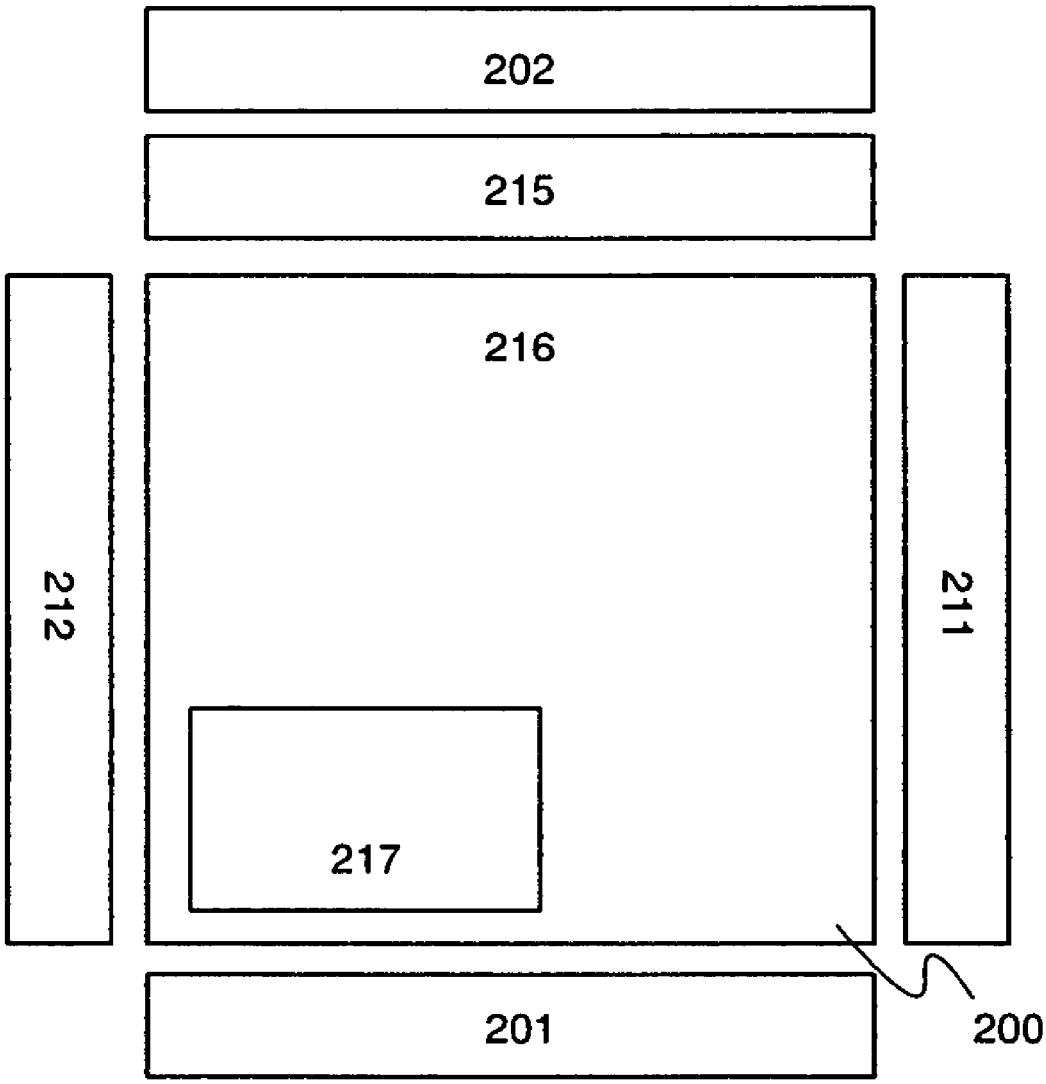
FIG. 2 is a diagram showing a display device according to the present invention.

FIG. 2 shows a multi-window display device, wherein a pixel portion 200, a first signal line driver circuit 211 and a first scanning line driver circuit 211 for the first screen, a second signal line driver circuit 202 and a second scanning line driver circuit 212 for the second screen, and a screen compression circuit 215 are provided on one and the same substrate.

The number of signal line driver circuits and scanning line driver circuits is not limited to which is given in FIG. 2, and combinations of one each, two signal line driver circuits and one scanning line driver circuit, or the like may be applied. A signal line driver circuit and a part thereof (a current source circuit, an amplifier circuit and the like) are not on the same substrate where a pixel is on, for example, they may be formed with external integrated circuit chips.

The structure described above allows display of a first screen 216 and a second screen 217, which is compressed against the first screen 216.

Accordingly, a load on an integrated circuit is reduced since the video signals for plural screens do not need to be stored in the memory. Further, display can be arbitrarily performed without storing the image data on the relative position and the size of each screen in the memory for signal processing.

Embodiment Mode 2

Figure 13:
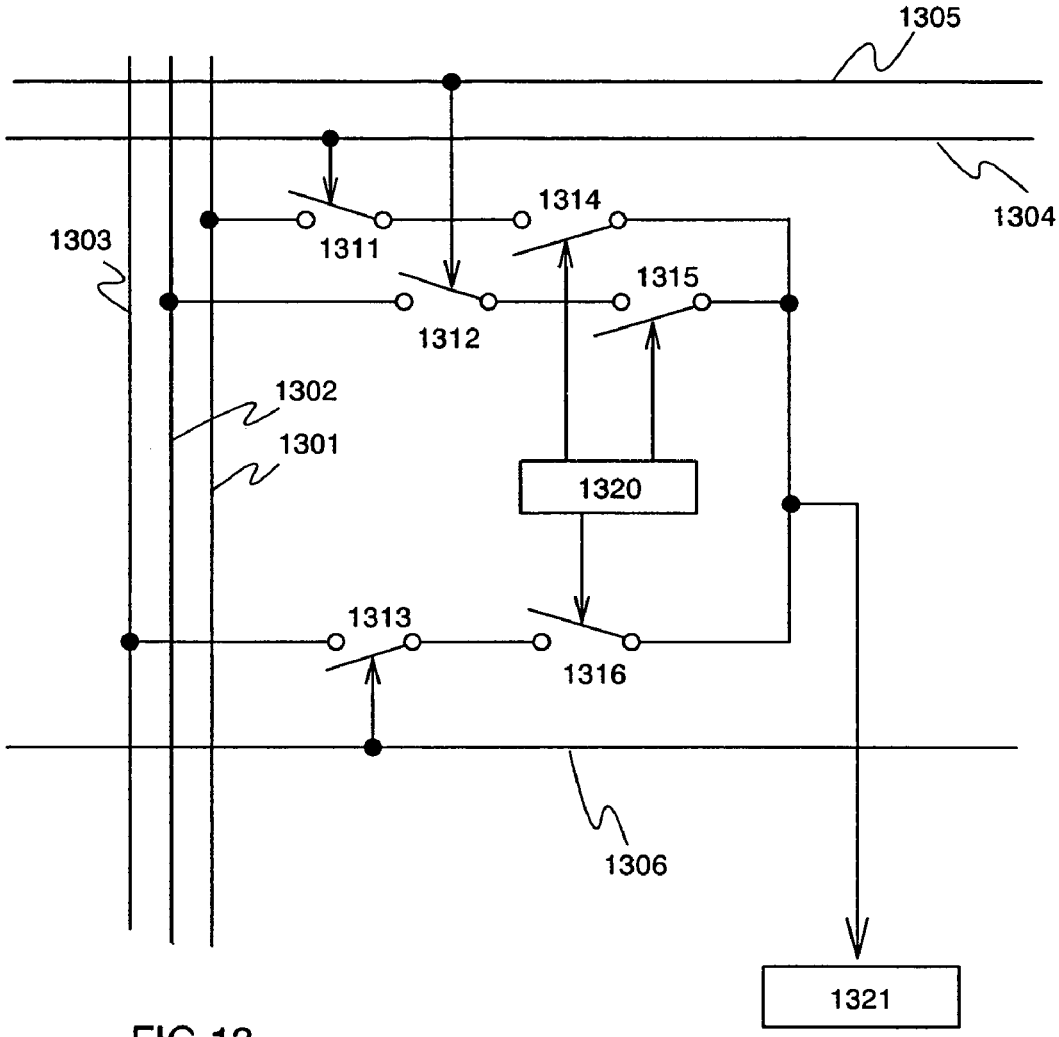
FIG. 13 is a diagram showing a pixel structure of a display device according to the present invention.

In this Embodiment Mode, a pixel structure of a multi-window display device having three screens is described referring to FIG. 13.

FIG. 13 shows a pixel structure, which includes: a first signal line (a signal line for a first screen) 1301; a first scanning line (a scanning line for the first screen) 1304; a first switch 1311 in which on/off is controlled based on the information of the first signal line 1301 and the first scanning line 1304; a second signal line (a signal line for a second screen) 1302 and a second scanning line (a scanning line for the second screen) 1305; a second switch 1312 in which on/off is controlled based on the information of a second signal line 1302 and a second scanning line 1305; a third signal line (a signal line for a third screen) 1303; a third scanning line (a scanning line for the third screen)1306; a third switch 1313 in which on/off is controlled based on the information of the first signal line 1303 and the first scanning line 1306; a fourth switch 1314, a fifth switch 1315, and a sixth switch 1316 in which on/off are controlled based on the information of a memory 1320 that are connected to the first switch 1311, the second switch 1312 and the third switch 1313 respectively; and a display element 1321 connected to the fourth switch 1314 to the sixth switch 1316.

Subsequently, one is selected from the fourth switch 1314, the fifth switch 1315 and the sixth switch 1316 by the memory 1320; the display element 1321 performs display based on the video signal from the signal line, which is connected to the selected switch.

Thus, in the case where the number of screens is increased, signal lines and scanning lines may be set fittingly so as to increase accordingly. Further, preferably, the number of memories are also increased accordingly as the number of screens is increased.

Embodiment Mode 3

In this embodiment mode, description will be made of a pixel structure including a signal line and a scanning line for a memory in the case of using a light emitting element with reference to FIGS. 3A and 3B.

Figure 3A:
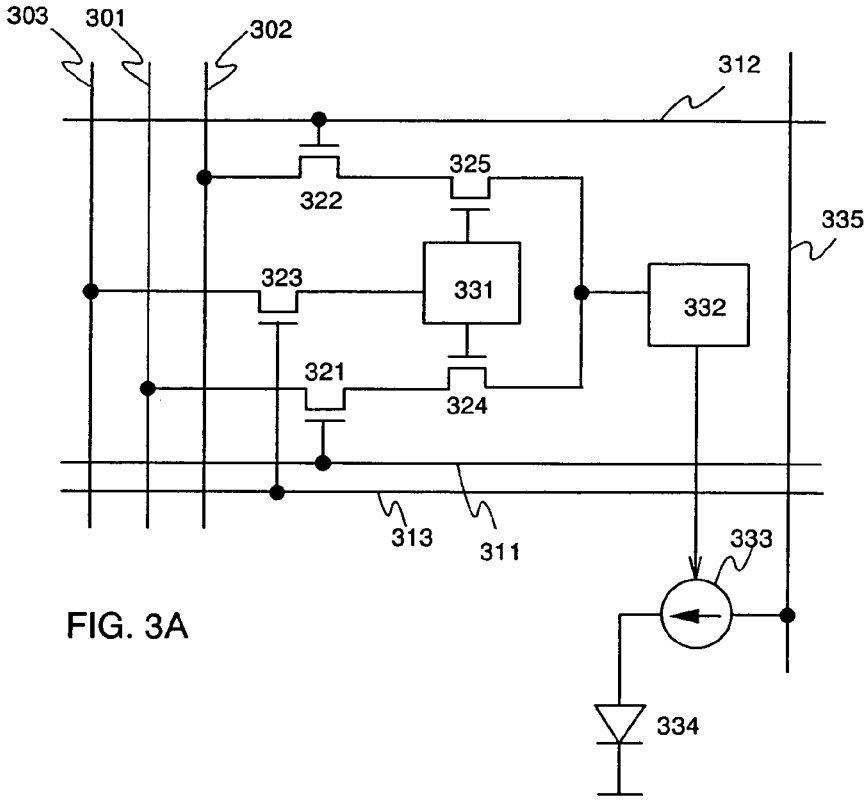
FIGS. 3A and 3B are diagrams showing pixel structures of a display device according to the present invention.

FIG. 3A shows a pixel that includes: a first signal line 301 and a first scanning line 311 for a first screen; a second signal line 302 and a second scanning line 312 for a second screen; a first memory 331 that selects the first scanning line or the second scanning line; a third signal line 303 and a third scanning line 313 for a first memory; a first transistor 321 connected with the first signal line and the first scanning line; a second transistor 322 connected with the second signal line and the second scanning line; a third transistor 323 connected with the third signal line and the third scanning line; a fourth transistor 324 and a fifth transistor 325 which are connected with the first memory and respectively connected with the first transistor and the second transistor; a second memory 332 connected with the fourth transistor and the fifth transistor; a current source 333 connected with the second memory; a power source line 335 that supplies a current to the current source; and a light emitting element 334.

First, a signal concerning which screen is displayed with the pixel between the first screen and the second screen is inputted to the first memory 331 from the third signal line 303. At this time, the third scanning line 313 is selected, and the third transistor is in an on state.

First, either the fourth transistor 324 or the fifth transistor 325 is turned on based on the input signal. Then, a video signal is inputted from one of the first transistor 321 and the second transistor 322, which is connected with the turned-on transistor.

Then, the video signal is inputted to the second memory, and a current is supplied to the current source 333 from the power source line 335 in accordance with the video signal. As a result, the light emitting element 334 emits light.

At this time, even if the video signal is inputted to the. not-selected one of the first transistor and the second transistor, the video signal is not supplied to the second memory. Thus, the video signal is neither input by mistake nor rewritten.

Further, either the first screen or the second screen may be compressed by the image compression circuit shown in FIG. 1B, thereby performing multi-window display.

Figure 3B:
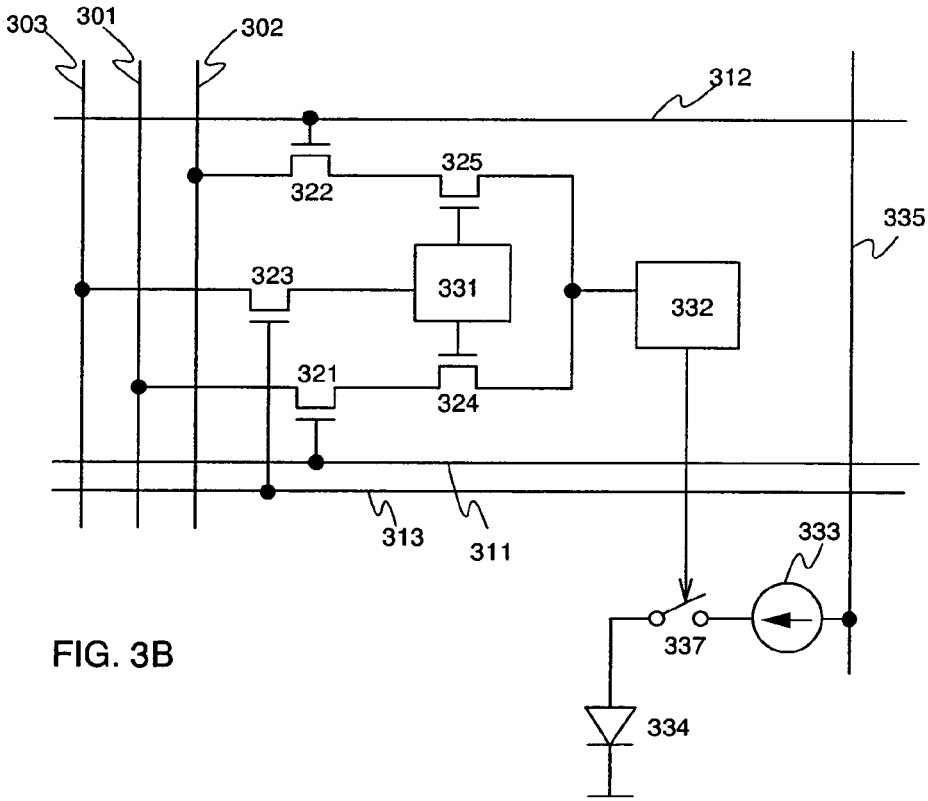

In this embodiment mode, there can be provided a pixel structure, in which a switch 337 controlled by the second memory 332 is provided between the current source 333 and the light emitting element 334, in FIG. 3B in combination with the pixel structure disclosed in WO 03/027997. With the pixel structure, a signal current is set in the current source 333, and the set signal current can be supplied to the light emitting element based on on/off of the switch 337. Thus, there can be reduced an influence of variation in threshold value of the transistors each of which constitutes the current source 333.

With the structures in this embodiment mode, a load on an integrated circuit can be reduced since the video signals for plural screens do not need to be stored in the memory. Further, display can be arbitrarily performed without storing the image data on the relative position and the size of each screen in the memory for signal processing.

Further, analog drive or digital drive can be adapted for a multi-window display device having light emitting elements. However, in the case where the display device is used for the analog drive that does not require a circuit for holding video signals, the load on an integrated circuit is reduced because another signal processing circuit does not need to be provided.

Embodiment Mode 4

In this embodiment mode, description will be made of a pixel structure including a signal line and a scanning line for a memory in the case of using a light crystal element with reference to FIG. 4.

Figure 4:
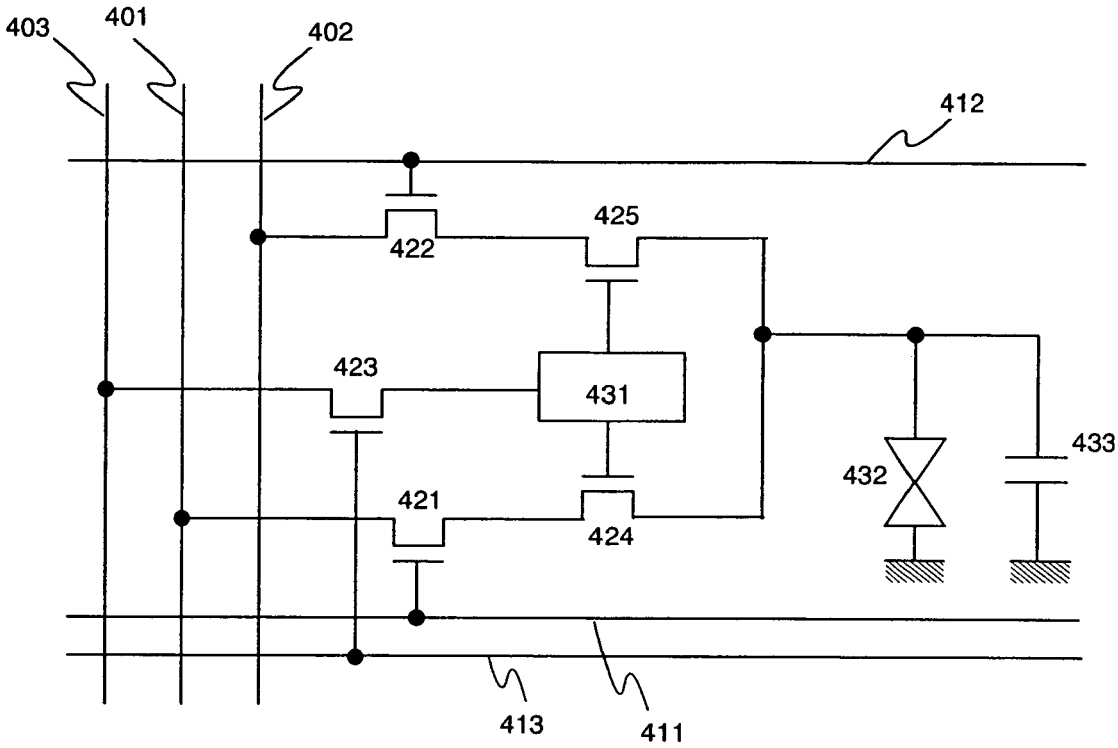
FIG. 4 is a diagram showing a pixel structure of a display device according to the present invention.

FIG. 4 shows a pixel that includes: a first signal line 401 and a first scanning line 411 for a first screen; a second signal line 402 and a second scanning line 412 for a second screen; a first memory 431 that selects the first scanning line or the second scanning line; a third signal line 403 and a third scanning line 413 for a first memory; a first transistor 421 connected with the first signal line and the first scanning line; a second transistor 422 connected with the second signal line and the second scanning line; a third transistor 423 connected with the third signal line and the third scanning line; a fourth transistor 424 and a fifth transistor 425 which are connected with the first memory and respectively connected with the first transistor and the second transistor; a liquid crystal element 432 connected with the fourth transistor and the fifth transistor; and a capacitance 433.

Note that the pixel structure in this embodiment mode corresponds to the structure obtained by replacing the light emitting element in Embodiment Mode 1 by the liquid crystal element 432 and the capacitor element 433, and an operation method for the structure is the same as that in Embodiment Mode 1. Thus, only a different part of the operation method will be explained.

First, either the fourth transistor 424 or the fifth transistor 425 is turned on as in Embodiment Mode 1. Then, a video signal is inputted from one of the first transistor 421 and the second transistor 422, which is connected with the turned-on transistor, and electric charge is held in the capacitor element 433. Orientation of the liquid crystal element is controlled based on the charge amount, and display of a pixel portion is performed.

Further, either the first screen or the second screen may be compressed by the image compression circuit shown in FIG. 1B, thereby performing multi-window display.

With the structures in this embodiment mode, a load on an integrated circuit can be reduced since the video signals for plural screens do not need to be stored in the memory. Further, display can be arbitrarily performed without storing the image data on the relative position and the size of each screen in the memory for signal processing.

Embodiment Mode 5

In this embodiment mode, description will be made of a pixel structure including a specific memory (the first memory in FIGS. 3A and 3B) with reference to FIGS. 5A and 5B. Note that the memory indicates the minimum unit that has a function of storing data. Then, the second memory is omitted in FIG. 5A and FIG. 5B.

Figure 5A:
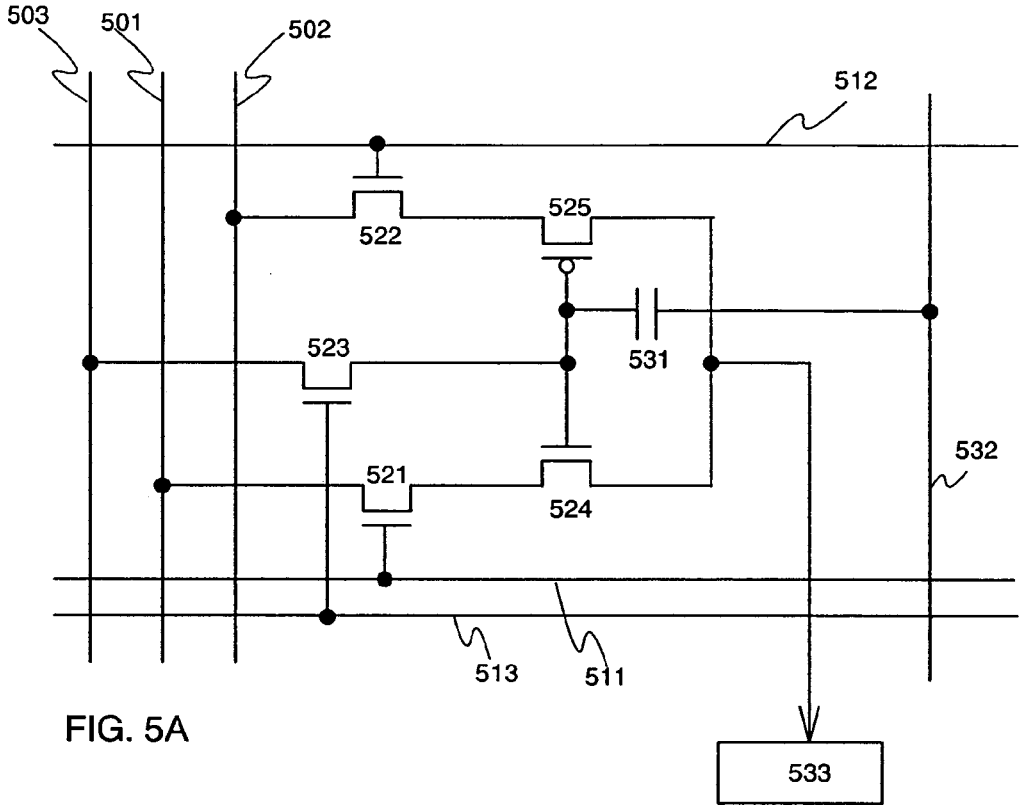
FIGS. 5A and 5B are diagrams showing pixel structures of a display device according to the present invention.

FIG. 5A shows a pixel structure in which transistors with different polarities and a capacitor constitute a unit that has a function of a memory. Similarly to the FIGS. 3A and 3B and FIG. 4, the pixel structure includes: a first signal line 501; a first scanning line 511; a second signal line 502; a second scanning line 512; a third signal line 503; a third scanning line 513; a first transistor 521; a second transistor 522; a third transistor 523; a fourth transistor 524 and a fifth transistor 525 with different polarities; a capacitor element 531 connected with respective gate electrodes of the fourth transistor and the fifth transistor and with a wiring 532; and a display element 533 connected with the fourth transistor and the fifth transistor.

Then, when the third transistor 523 is turned on, a High or Low signal is inputted from the third signal line 503. Assuming that the fourth transistor 524 is an n-channel transistor while the fifth transistor 525 is a p-channel transistor, the fourth transistor 524 is turned on when the High signal is output from the third transistor 523. On the contrary, the fifth transistor 525 is turned on when the Low signal is output from the third transistor.

Then, a current is supplied from the fourth transistor 524 or the fifth transistor 525, and is held in the capacitor element 531. Thereafter, a video signal is supplied to the display element 533. At this time, the current is held in the capacitor element 531, whereby the transistors 524 and 525 can be controlled based on constant data.

Figure 5B:
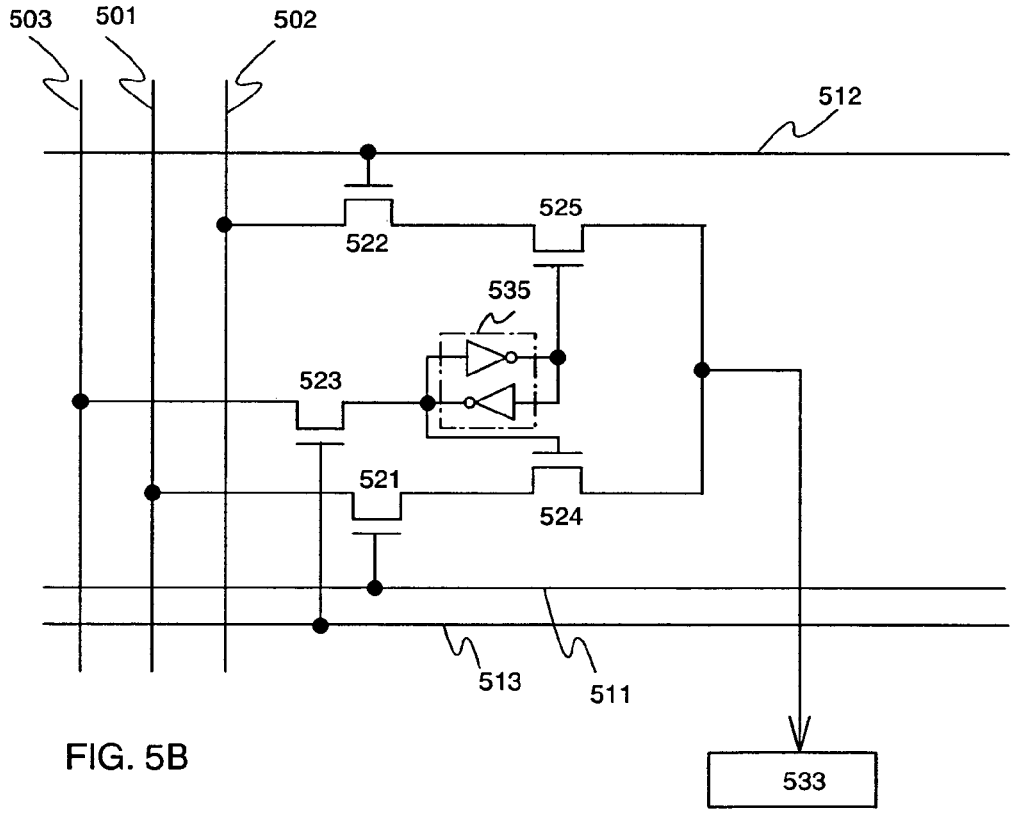

Next, FIG. 5B shows a pixel structure that constitutes a unit that has a function of a memory with the use of an SRAM including a latch circuit.

The input side of an SRAM 535 is connected with one of electrodes of the transistor 523 and a gate electrode of the transistor 524.

The SRAM 535 has two transistors for each of different polarities. For example, a p-channel transistor and an n-channel transistor constitute a pair, and two pairs of the p-channel transistor and the n-channel transistor exist in the SRAM.

As to the two pairs of the transistors, drain regions thereof are connected with each other, and also, gate electrodes thereof are connected with each other. The drain region of one of the pairs of the transistors is kept to have the same potential as that of the gate electrode of the other pair of the transistors. Then, an input signal (Vin) is inputted to the drain region of one of the pairs of the transistors while an output signal (Vout) is output from the drain region of the other pair of the transistors. That is, the SRAM is designed so as to hold Vin and output Vout that is a signal obtained by inverting Vin. Then, the output side of the SRAM 535 is connected with the transistor 524 and the transistor 525, and the transistors 524 and 525 can be controlled in accordance with output Vout.

Further, the above-described SRAM does not require a refresh operation, and thus, a timing of a memory operation can be adjusted with ease.

Note: that a known circuit may also be used for the memory, in addition to ones shown in FIGS. 5A and 5B.

Moreover, plural memories may be provided. In particular, plural memories are preferably provided in the case of performing multi-window display with three or more screens.

Figure 14:
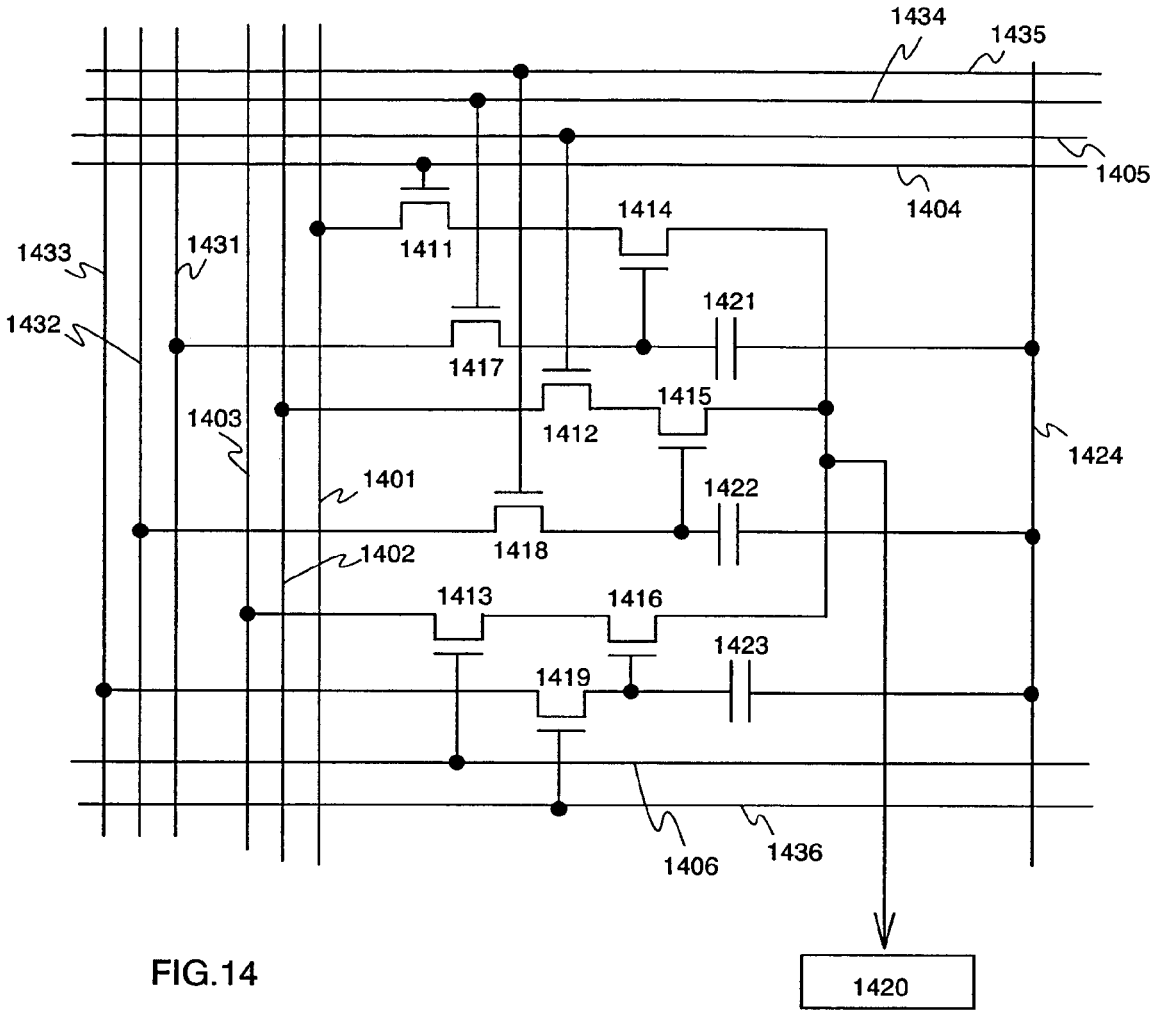
FIG. 14 is a diagram showing a pixel structure of a display device according to the present invention.

For example, as shown in FIG. 14, there may be provided a pixel structure that includes: a first signal line 1401; a first scanning line 1404; a transistor 1411 connected with those lines; a transistor 1414 connected with the transistor 1411; a capacitor element 1421 connected with a gate electrode of the transistor 1414 and a transistor 1417 that controls on/off of the transistor 1414; a signal line 1431 and a scanning line 1434 that are connected with the transistor 1417; a second signal line 1402; a second scanning line 1405; a transistor 1412 connected with those lines; a transistor 1415 connected with the transistor 1412; a capacitor element 1422 connected with a gate electrode of the transistor 1415 and a transistor 1418 that controls on/off of the transistor 1415; a signal line 1432 and a scanning line 1435 that are connected with the transistor 1418; a third signal line 1403; a third scanning line 1406; a transistor 1413 connected with those lines; a transistor 1416 connected with the transistor 1413; a capacitor element 1423 connected with a gate electrode of the transistor 1416 and a transistor 1419 that controls on/off of the transistor 1416; a signal line 1433 and a scanning line 1436 that are connected with the transistor 1419; a power source line 1424 connected with the capacitor elements 1421, 1422, and 1423; and a display element 1420 connected with the transistors 1414, 1415, and 1416.

In the structure of FIG. 14, a unit that has a function of a memory includes the transistor 1417 and the capacitor element 1421. That is, three memories are provided in the structure of FIG. 14.

Then, one pair is selected from the signal lines 1431 to 1433 and the scanning lines 1434 to 1436, as a result of which one of the transistors 1417 to 1419, which control on/off, is turned on.

For example, when the signal line 1431 and the scanning line 1434 are selected, and then, the transistor 1417 is turned on, a video signal from the signal line 1401 is supplied to the transistor 1414 through the transistor 1411 selected by the scanning line 1404 to thereby be held in the capacitor element 1421. Thereafter, the video signal is supplied to the display element 1420, as a result of which display is performed. Further, the transistors 1418, 1419 that control on/off and the like are operated in a similar manner. Thus, the selected transistor, that is, the video signal for the selected screen is supplied to the display element.

Thus, the pixel structures shown in FIG. 14 may be applied in the case where (an odd number of) plural memories are provided.

Further, the pixel structures shown in FIGS. 5A and 5B may be applied in the case where (an even number of) plural memories are provided.

As described above, the memory, which is inputted with the signal that selects either the first signal line or the second signal line, is used. Therefore, a load on an integrated circuit can be reduced since the video signals for plural screens do not need to be stored in the memory.

Embodiment Mode 6

In this embodiment mode, description will be made of a scanning line driver circuit and a driving method thereof with reference to timing charts shown in FIGS. 6A to 6D.

Figure 6A:
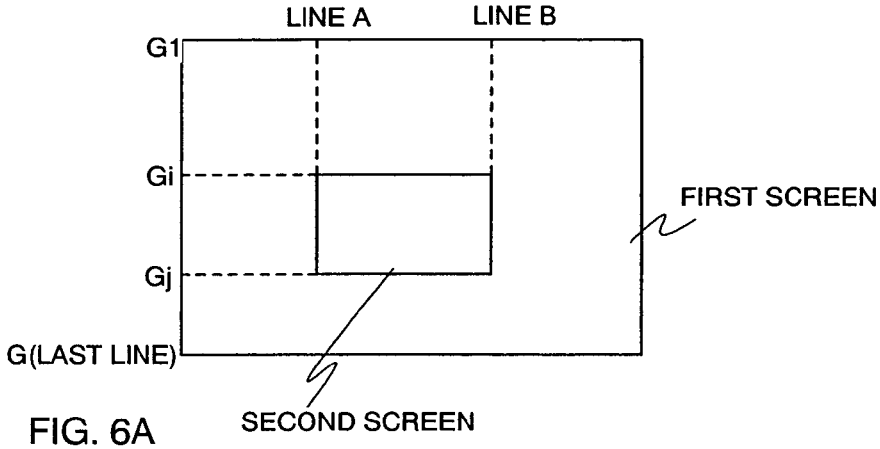
FIGS. 6A to 6D are diagrams showing a driving method of a display device according to the present invention.

As shown in FIG. 6A, description will be made of a pixel structure in which a second screen is provided in a range of A-th column to a B-th column and a Gi-th row to a Gj-th row in a pixel portion. Note that, although description is made of the case of the pixel structure in which the second screen is compressed with respect to a first screen in this embodiment mode, the first screen may be compressed with respect to the second screen. Alternatively, the pixel structure may be applied to multi-window display in which two or more screens are displayed.

Figure 6B:
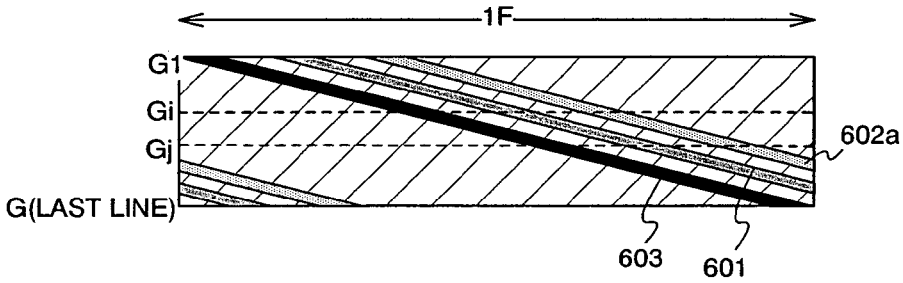
Figure 6C:
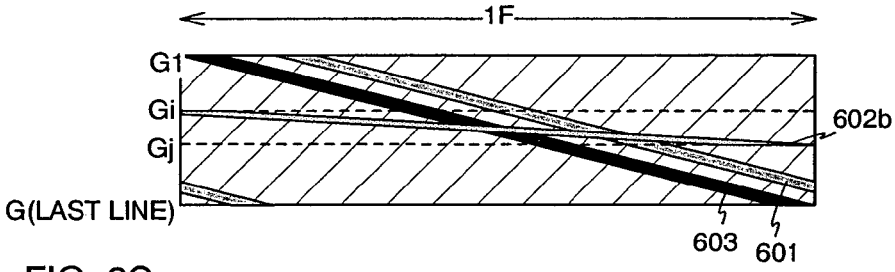
Figure 6D:
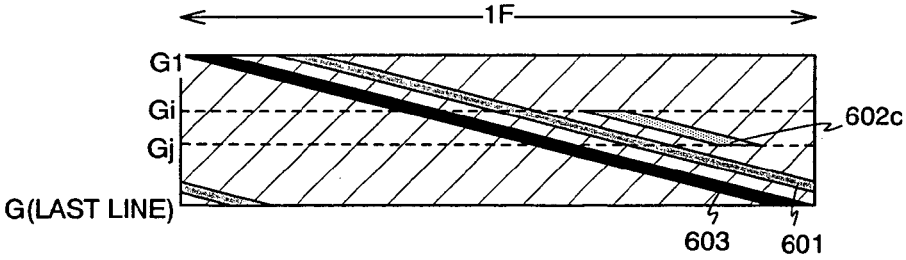

FIGS. 6B to 6D are timing charts in the case of performing the multi-window display shown in FIG. 6A.

In FIG. 6B, there are shown a frame period (also referred to as unit frame period) F1 in which scanning lines are selected in a range of first to last rows, a first writing period 601 during which a signal is inputted to the first screen, a second writing period 602*a* during which a signal is inputted to the second screen, and a third writing period 603 during which a signal is inputted to a memory.

First, in the first frame period, writing is performed from G1 to G (the last row) with a third scanning line (the third writing period 603). Thereafter, writing is performed from G1 to G (the last row) with a first scanning line (the first writing period 601). Subsequently, writing is performed from G1 to G (the last row) with a second scanning line (the second writing period 602).

Note that the order of the first to third writing periods maybe changed without problems. However, data for displaying the first screen or the second screen needs to be input to the memories of all the pixels. Therefore, in the first frame period, the first or second writing period needs to be provided after writing is performed in the third writing period 603. Further, data does not need to be rewritten for each frame in the periods other than the first frame period, and thus, the first to third writing periods are not necessarily provided in each of all the frame periods.

As described above, the operation of the scanning line driver circuit can be performed independently for each of the scanning lines. Therefore, the scanning lines may select a certain row at one time, or may select different rows.

Further, FIG. 6C is a timing chart different from that in FIG. 6B in point of the second writing period.

As shown in FIG. 6C, writing is performed only in the rows (Gi to Gj) which display the second screen in a second writing period 602*b*, and further, writing is performed over one frame period.

As described above, writing is performed only for the scanning line for the screen to be compressed at much expense in time, whereby data can be written with reliability.

Moreover, as shown in FIG. 6D, it may be that: only Gi to Gj are selected with the second scanning line in the second screen; and writing is performed at the same speed as that of each of the first writing period and the third writing period.

As described above, writing into unnecessary rows is not performed in the scanning line driver circuit for the screen to be compressed. Therefore, malfunction of the circuit can be reduced.

Embodiment Mode 7

In this embodiment mode, description will be made of a specific structure and operation method of a screen compression circuit for performing compression of a first screen or second screen in a lateral direction (direction perpendicular to signal lines) in a panel with reference to FIGS. 7A and 7B.

Figure 7A:
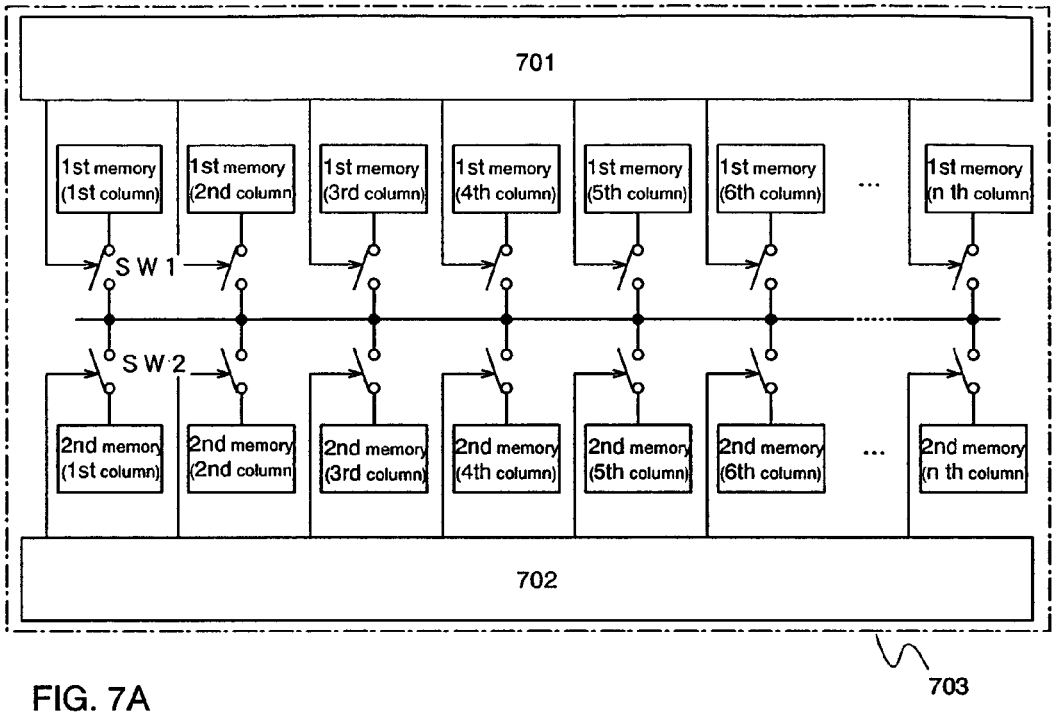
FIGS. 7A and 7B are diagrams showing a screen compression circuit according to the present invention.

A screen compression circuit 703 in FIG. 7A includes first memories corresponding to the number of signal lines, first switches SW1 connected with the respective first memories, a first control circuit 701 that controls the switches SW1, second memories, second switches SW2 connected with the respective second memories, and a second control circuit 702 that controls the switches SW2.

First, image data for one row before compression is stored in the first memories. The image data is compressed based on a target screen size to be compressed, and is inputted to the second memories. That is, it is sufficient that the first control circuit 701 and the second control circuit 702 adjust a timing at which the first switches SW1 are turned on with a timing at which the second switches SW2 are turned on. Then, as shown in Embodiment Mode 5, it is sufficient that the scanning line driver circuit adjusts a display position (column) of the screen to be compressed.

Description will be made of, for example, the case where the second screen is displayed from the second column to achieve compression of the screen size to ⅓ with reference to a timing chart of FIG. 7B.

Figure 7B:
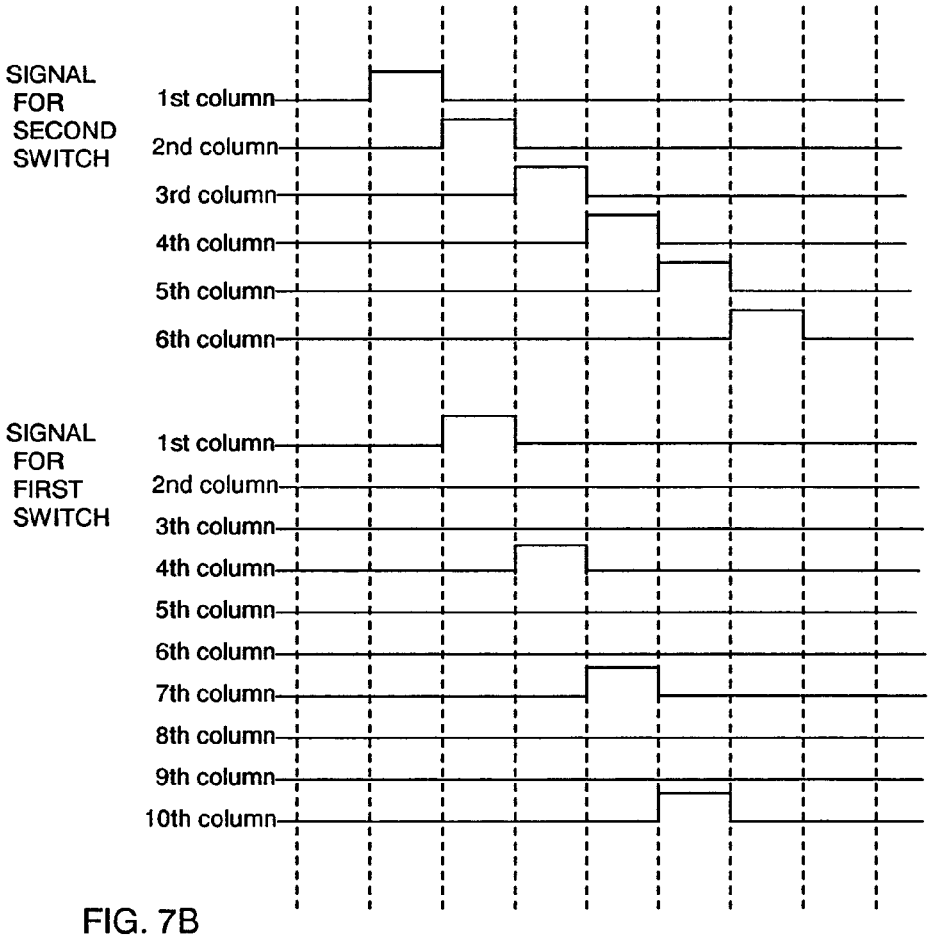

Shown in FIG. 7B are timings at which the second control circuit 702 inputs High signals to the second memories in the first to sixth columns and timings at which the first control circuit 701 inputs the High signals to some of the first memories in the first to tenth columns. Note that signals are similarly input to the second memories in the seventh column and the subsequent columns and the first memories in the eleventh column and the subsequent columns.

First, the selection switches of the second memories are successively selected. At this time, since display is started from the second column in regard to the second screen, the High signal is not input to the first switch synchronized with the second switch in the first column. That is, any data may be input in the second switch in the first column because an image is not displayed in relation to the second switch.

Next, the High signal is inputted to the first switch in the first column in synchronization with the second switch in the second column. Then, data of the first memory in the first column is transferred (input) to the second memory in the second column. Note that, at this time, it is sufficient that data of one of the first memories in the first to third columns is transferred to the second memory in the second column, and further, it is preferable that an average value of the data of the first memories be transferred.

Next, the High signal is inputted to the first switch in the fourth column in synchronization with the second switch in the third column. Then, data of the fourth memory in the first column is transferred (input) to the second memory in the third column. Note that, at this time, it is sufficient that data of one of the first memories in the fourth to sixth columns is transferred to the second memory in the third column, and further, it is preferable that an average value of the data of the first memories be transferred.

Next, the High signal is inputted to the first switch in the seventh column in synchronization with the second switch in the fourth column. Then, data of the first memory in the seventh column is transferred (input) to the second memory in the fourth column. Note that, at this time, it is sufficient that data of one of the first memories in the seventh to ninth columns is transferred to the second memory in the fourth column, and further, it is preferable that an average value of the data of the first memories be transferred.

Next, the High signal is inputted to the first switch in the tenth column in synchronization with the second switch in the fifth column. Then, data of the first memory in the tenth column is transferred (input) to the second memory in the fifth column. Note that, at this time, it is sufficient that data of one of the first memories in the tenth to twelfth columns is transferred to the second memory in the fifth column, and further, it is preferable that an average value of the data of the first memories be transferred.

Hereafter, the selected first memory is similarly transferred to the second memory in all the columns. Then, the image data of the second memory is inputted to the signal line for the second screen, as a result of which display is performed.

The screen compression circuit is operated as described above, and thus, the image can be compressed or thinned down in the lateral direction. Note that compressing indicates inputting of the average value of the first memories to the second memory and that thinning down indicates inputting of the selected first memory to the second memory. Note that it is sufficient that the first control circuit and the second control circuit each are a circuit that outputs a waveform shown in FIG. 7B. For example, a shift register circuit or a decoder circuit may be used.

Note that the display position and size of the screen to be compressed can be freely set by changing the waveform (timing) of the signal for first switch. Therefore, the screen to be compressed may have an arbitrary shape, for example, a triangular shape and a round shape besides a rectangular shape.

Further, even in the case where an image in a longitudinal direction is to be compressed or thinned down, data of only necessary rows may be written to pixels in the same manner.

The above-described screen compression circuit enables arbitrary multi-window display without storing the image data on the relative position and the size of each screen in the memory for signal processing.

Embodiment Mode 8

In this embodiment mode, description will be made of a pixel structure in the case of two-screen display with the use of a light emitting element serving as a display element with reference to FIGS. 8A and 8B. Note that, in the pixel structure, a source electrode and a drain electrode of a transistor are determined based on a current flowing direction, and are not limitedly fixed. Thus, the electrodes are referred as a first electrode and a second electrode in this embodiment mode.

Figure 8A:
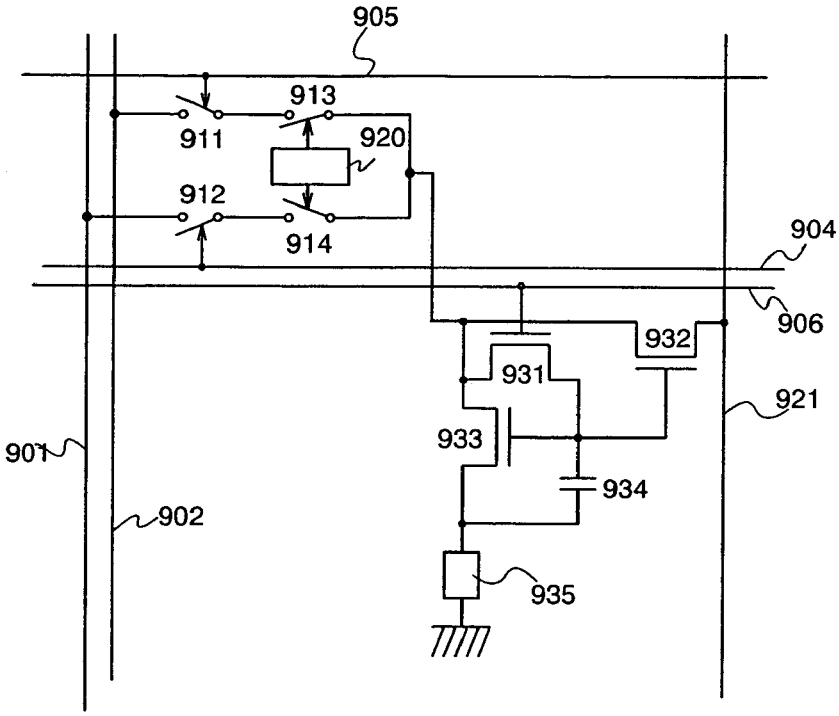
FIGS. 8A and 8B are diagrams showing pixel structures of a display device according to the present invention.

A pixel in FIG. 8A includes: a signal line 901 and a scanning line 904 for a first screen; a switch 912 connected with those lines; a signal line 902 and a scanning line 905 for a second screen; a switch 911 connected with those lines; a memory 920; switches 913 and 914 connected with the memory; a power source line 921; a holding transistor 931; a driving transistor 932; a conversion driving transistor 933; a capacitor element 934; and a light emitting element 935.

Then, a gate electrode of the transistor 931 is connected with a scanning line 906; a first electrode thereof is connected with the switches 913 and 914 and with a first electrode of the transistor 932; and a second electrode thereof is connected with a gate electrode of the transistor 933 and a gate electrode of the transistor 932. A second electrode of the transistor 932 is connected with the power source line 921, and a second electrode of the transistor 933 is connected with one of electrodes of the light emitting element 935. The capacitor element 934 is connected between the gate electrode and the second electrode of the transistor 933, and holds a gate-source voltage of the transistor 933. The power source line 921 and the other electrode of the light emitting element 935 are respectively input with predetermined potentials, which have a potential difference with one another.

First, a signal that displays either the first screen or the second screen is inputted to each of the memories in all the pixels. The switch 914 or 913 is selected in accordance with the signal, and a predetermined current serving as a video signal is inputted from the signal line connected with the selected switch. When the transistor 931 connected with the scanning line 906 is turned on, the current is started to flow to the transistor 932, and electric charge is stored in the capacitor element 934. Thereafter, the current kept constant is supplied to the light emitting element through the transistor 933, as a result of which multi-window display is performed.

As to a pixel in FIG. 8B, description will be made only of a part of the structure different from the pixel structure in FIG. 8A, and the same structural parts are denoted by the same reference numerals.

Figure 8B:
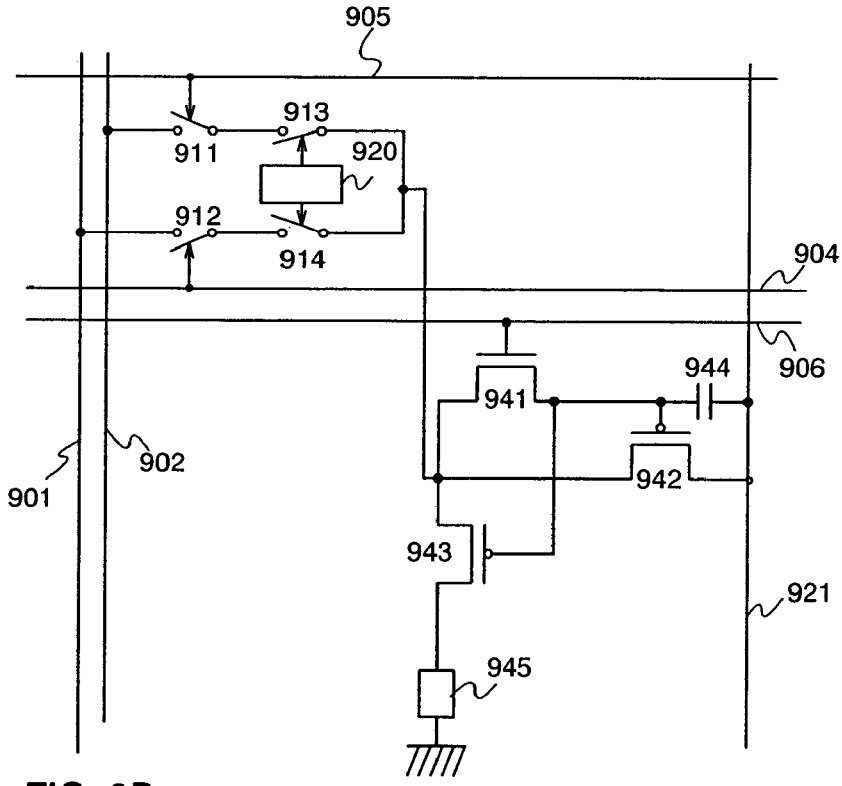

The pixel in FIG. 8B includes: the signal line 901 and the scanning line 904 for the first screen; the switch 912 connected with those lines; the signal line 902 and the scanning line 905 for the second screen; the switch 911 connected with those lines; the memory 920; the switches 913 and 914 connected with the memory; the power source line 921; a holding transistor 941; a driving transistor 942; a conversion driving transistor 943; a capacitor element 944; and a light emitting element 945.

A gate electrode of the transistor 941 is connected with the scanning line 906; a first electrode thereof is connected with a first electrode of the transistor 943; and a second electrode thereof is connected with a gate electrode of the transistor 942. A second electrode of the fourth transistor 942 is connected with the power source line 921, and a second electrode of the third transistor 943 is connected with one of electrodes of the light emitting element 945. The capacitor element 944 is connected between the gate electrode and the second electrode of the fourth transistor 942, and holds a gate-source voltage of the fourth transistor 942. The power source line 921 and the other electrode of the light emitting element 945 are respectively input with predetermined potentials, which have a potential difference with one another.

First, a signal that displays either the first screen or the second screen is inputted to each of the memories in all the pixels. The switch 914 or 913 is selected in accordance with the signal, and a video signal is inputted from the signal line connected with the selected switch. When the transistor 941 connected with the scanning line 906 is turned on, a current is started to flow to the transistor 942, and electric charge is stored in the capacitor element 944. Thereafter, the current kept constant is supplied to the light emitting element through the transistor 943, as a result of which multi-window display is performed.

With the pixel structures as described above, a load on an integrated circuit can be reduced since the video signals for plural screens do not need to be stored in the memory mounted on the integrated circuit. Further, display can be arbitrarily performed without storing the image data on the relative position and the size of each screen in the memory for signal processing.

Further, due to the fact that the pixel structure is insensitive to the influence of the lowering of an aperture ratio which arises from the arranged signal lines, scanning lines, and transistors, an upper surface emission type emission display device may be used which emits light to the opposite side to the substrate on which the transistors are provided.

Further, the above-described pixel structure enables reduction in variation of the transistors. As a result, multi-window display can be performed without nonuniformity of display and with higher precision.

The pixel structure is not limited to the structure in which a current serving as a video signal is inputted to the signal line 901 for the first screen and to the signal line 902 for the second screen as shown in FIGS. 8A and 8B, and a voltage serving as a video signal may be input to each of the signal lines.

Figure 15:
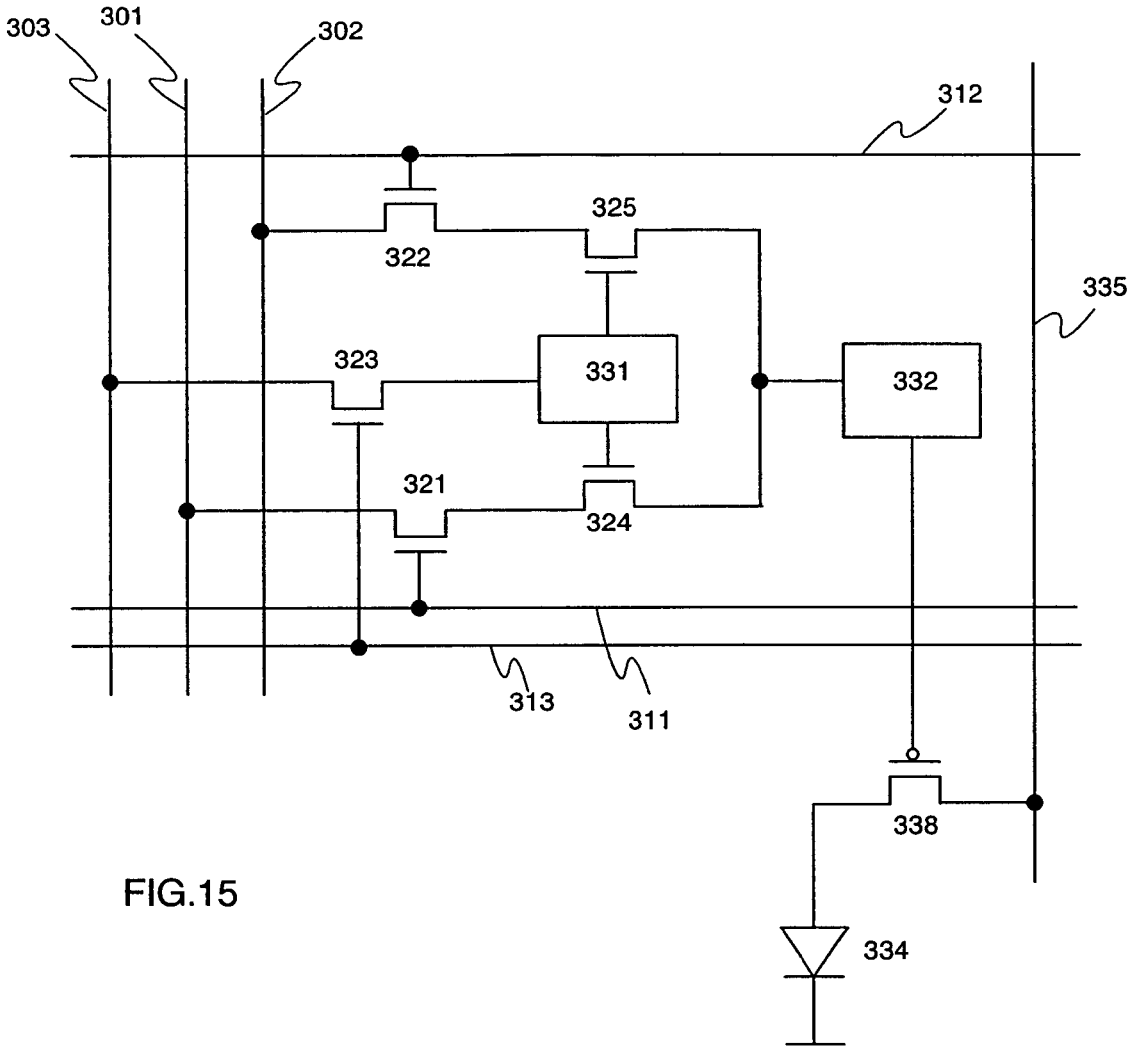
FIG. 15 is a diagram showing a pixel structure of a display device according to the present invention.

FIG. 15 shows a pixel structure in which a voltage serving as a video signal is inputted to each signal line. In FIG. 15, differently from the pixel structure in FIG. 3B, a current source corresponding to the current source 333 is not provided, and a p-channel transistor 338 corresponding to the switch 337 is provided and is connected with the light emitting element 334.

Similarly to FIG. 3B, the signal concerning which screen is displayed with the pixel between the first screen and the second screen is inputted to the first memory 331 from the signal line 303 for the memory. At this time, the third scanning line 313 is selected, and the transistor 323 is in an on state.

Then, a voltage serving as a video signal is inputted to the signal line 301 for the first screen or the signal line 302 for the second screen based on the first memory 331. The transistor 321 or 322 is turned on/off in accordance with the video signal, and the video signal is inputted to the second memory 332 from the transistor 324 or 325 connected with the turned-on transistor The second memory 332 turns the transistor 338 on/off. When the transistor 338 is turned on, the light emitting element 334 emits light.

Further, there may be provided a pixel structure that includes a correction circuit that corrects variation in threshold voltage of transistors.

Either analog gradation or digital gradation may be used as a multi-gradation display method in the embodiment modes and other embodiment modes. Further, the multi-gradation display may be combined with time gradation display or area gradation display.

EMBODIMENTS

Embodiment 1

As examples of electronic device equipped with a multi-window display device with a light emitting element or a liquid crystal element, video cameras, digital cameras, navigation systems, audio playback devices (car audios, audio components, etc.), notebook type personal computers, game machines, portable information terminals (mobile computers, mobile telephones, mobile type game machines, electronic books, etc.), image reproduction devices equipped with a recording medium (specifically, devices equipped with displays each of which is capable of reproducing a recording medium such as a digital versatile disk (DVD), etc. and displaying the image thereof), and the like are given. In particular, as for a portable information terminal whose screen is often viewed from a diagonal direction, since a wide angle of view is regarded as important, a multi-window display device with a light emitting element is desirably used. Specific examples of these electronic devices are shown in FIG. 12.

Figure 12A:
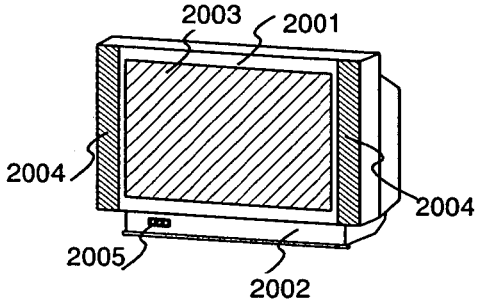
FIGS. 12A to 12G are diagrams showing electronic devices each of which uses the display device according to the present invention.

FIG. 12A shows a display device, which includes a frame 2001, a support base 2002, a display portion 2003, a speaker portion 2004, and a video input terminal 2005. The multi-window display device may be applied to the display portion 2003. Note that all light emitting devices for displaying information including light emitting devices for personal computers, those for receiving TV broadcasting, and those for displaying advertising are also included in the display device.

Figure 12B:
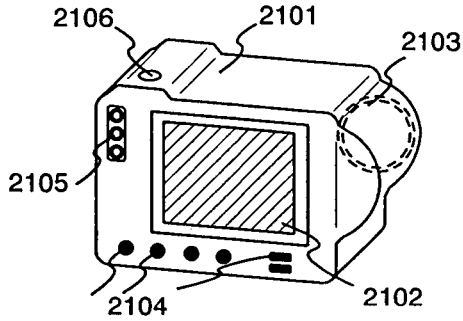

FIG. 12B shows a digital camera, which includes a main body 2101, a display portion 2102, an image-receiving portion 2103, operation keys 2104, an external connection port 2105, and a shutter 2106. The multi-window display device may be applied to the display portion 2102.

Figure 12C:
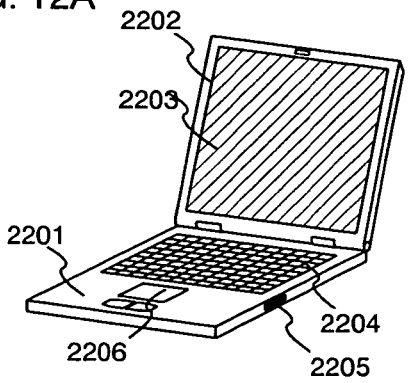

FIG. 12C shows a notebook type personal computer, which includes a main body 2201, a frame 2202, a display portion 2203, a keyboard 2204, external connection ports 2205, and a pointing mouse 2206. The multi-window display device may be applied to the display portion 2203.

Figure 12D:
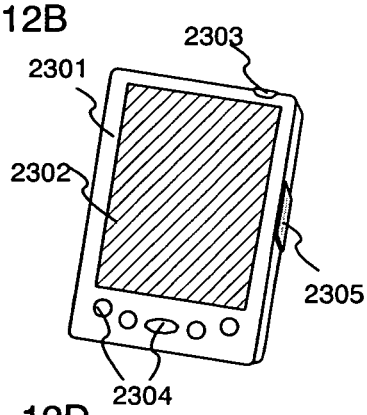

FIG. 12D shows a mobile computer, which includes a main body 2301, a display portion 2302, switches 2303, operation keys 2304, and an infrared port 2305. The multi-window display device may be applied to the display portion 2302.

Figure 12E:
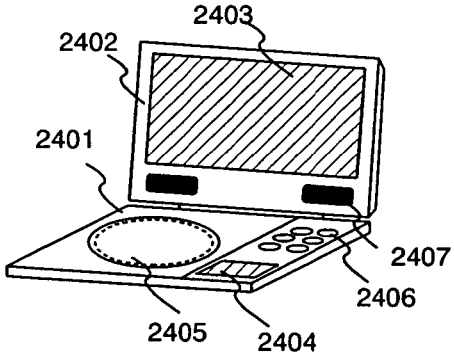

FIG. 12E shows a portable image reproduction device provided with a recording medium (specifically, a DVD playback device), which includes a main body 2401, a frame 2402, a display portion A 2403, a display portion B 2404, a recording medium (such as a DVD) read-in portion 2405, operation keys 2406, and a speaker portion 2407. The multi-window display device can be used in both the display portion A 2403 and in the display portion B 2404 while the display portion A 2403 mainly displays image information, and the display portion B 2404 mainly displays character information. Note that image reproduction device provided with a recording medium includes game machines for domestic use.

Figure 12F:
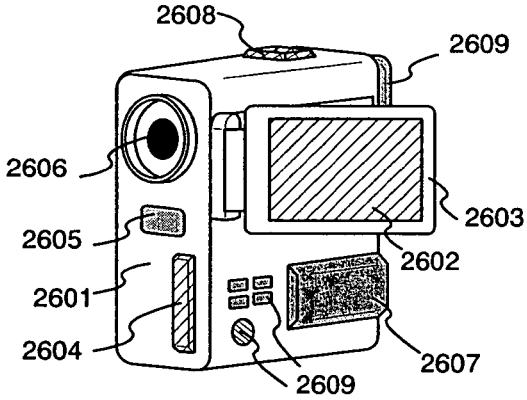

FIG. 12F shows a video camera, which includes a main body 2601, a display portion 2602, a frame 2603, external connection ports 2604, a remote-controlled receiving portion 2605, an image receiving portion 2606, a battery 2607, an audio input portion 2608, and operation keys 2609. The multi-window display device may be applied to the display portion 2602.

Figure 12G:
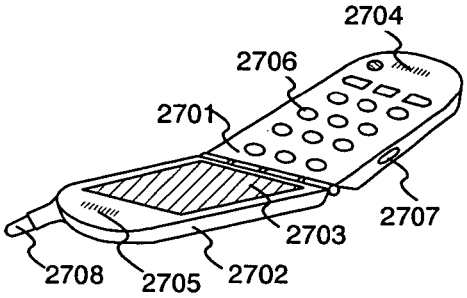

Here, FIG. 12G shows a mobile telephone, which includes a main body 2701, a frame 2702, a display portion 2703, an audio input portion 2704, an audio output portion 2705, operation keys 2706, external connection ports 2707, and an antenna 2708. The multi-window display device may be applied to the display portion 2703. Note that by displaying white characters on a black background, the display portion 2703 can suppress the power consumption of the mobile telephone.

Note that if light including the output image information is magnified and projected with a lens or the like, it will be possible to use the multi-window display device in front type projectors or rear type projectors.

As described above, the display device of the present invention can be used in electronic devices in various fields. Further, the electronic device of this embodiment may use any one of the pixel structure or signal line driver circuit configurations of Embodiment Modes 1 to 7.

Embodiment 2

In the electronic device having the light emitting elements shown in Embodiment 1, a module in a state, in which ICs including a controller, a power source circuit, and the like are provided, is mounted to a panel in a state in which light emitting elements are sealed. The module and the panel each correspond to a form of a display device. In this embodiment, description will be made of a specific structure of the module.

Figure 9A:
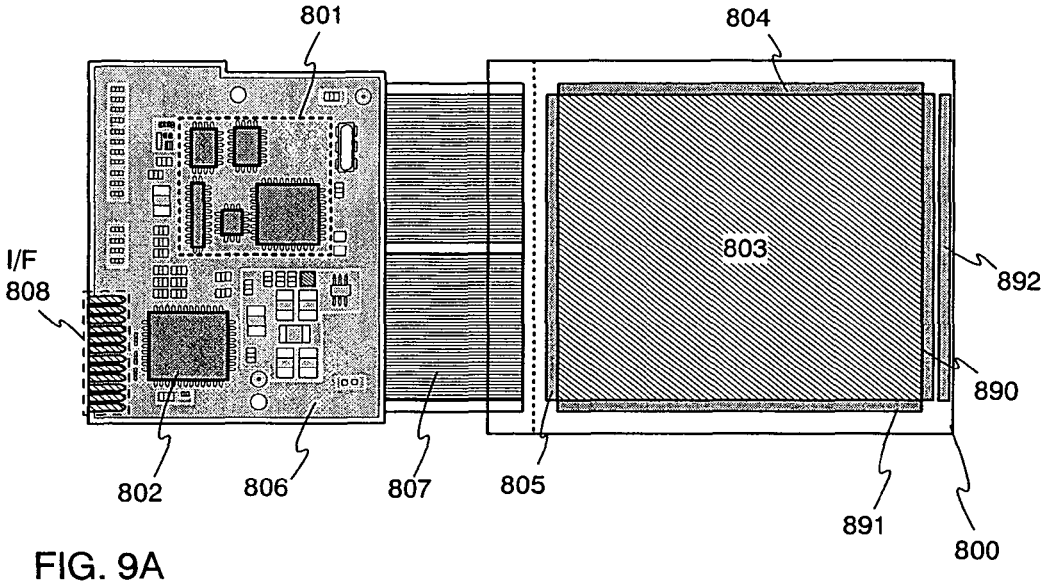
FIGS. 9A and 9B are diagrams showing the whole of a display device according to the present invention.

FIG. 9A is a diagram showing an outer appearance of a module in which a controller 801 and a power source circuit 802 are mounted to a panel 800. Provided to the panel 800 are a pixel portion 803 in which light emitting elements are provided to respective pixels, a scanning line driver circuit portion that selects a display element (pixel) in the pixel portion 803, and a signal line driver circuit portion that supplies a video signal to the selected pixel. Note that the signal line driver circuit portion includes a first signal line driver circuit 805 for a first screen and a second signal line driver circuit 892 for a second screen, and the scanning line driver circuit portion includes a first scanning line driver circuit 804 for the first screen and a second scanning line driver circuit 891 for the second screen. In addition, a screen compression circuit 890 that compresses a screen is provided to the panel 800.

Further, the controller 801 and the power source circuit 802 are provided to a printed substrate 806. Respective signals and a power source voltage, which are output from the controller 801 or the power source circuit 802, are supplied to the pixel portion 803, the scanning line driver circuit 804, and the signal line driver circuit 805 through an FPC 807.

The power source voltage and the respective signals are supplied to the printed substrate 806 through an interface (I/F) portion 808 in which plural input terminals are arranged. The I/F portion needs to be provided in correspondence with the number of multi-window screens. However, description will be made of an operation of one I/F portion in this embodiment.

Note that, although the printed substrate 806 is mounted to the panel 800 with the use of the FPC in this embodiment, the present invention is not necessarily limited to the structure. The controller 801 and the power source circuit 802 may be directly mounted to the panel 800 by using a COG (chip on glass) method.

Further, in the printed substrate 806, noise develops to the power source voltage or signal, or the rise of the signal becomes slow due to a capacitance formed between drawn wirings, resistance of the wiring itself, and the like in some cases. Therefore, various elements such as a capacitor and a buffer may be provided to the printed substrate 806, thereby preventing the noise from developing to the power source voltage or signal or preventing the rise of the signal from becoming slow.

Figure 9B:
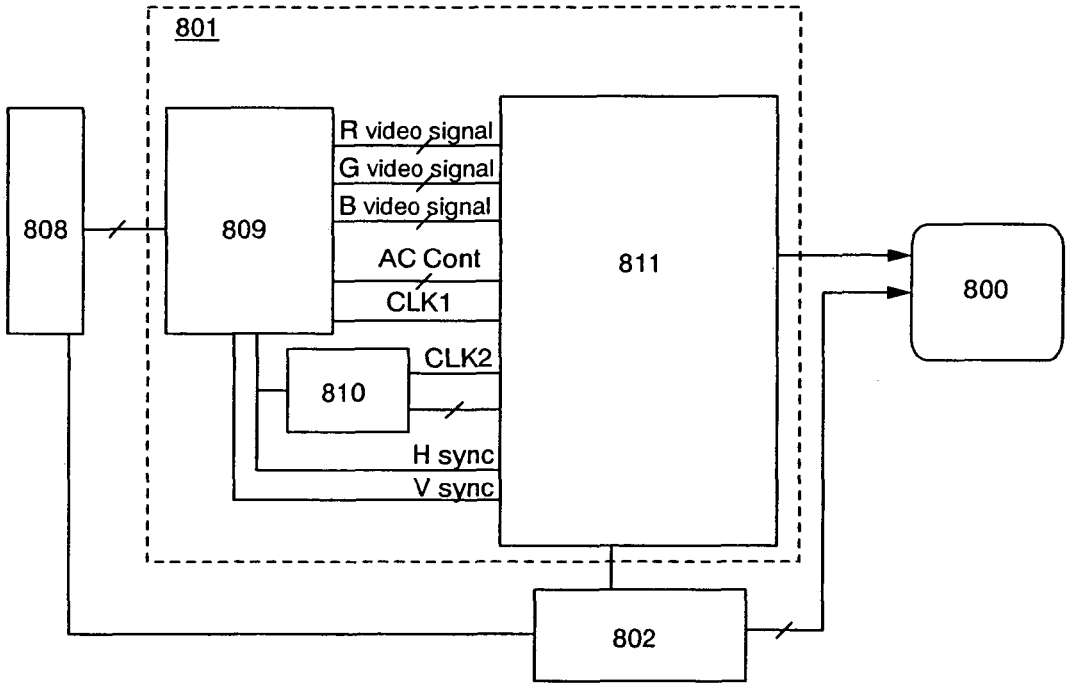

FIG. 9B is a block diagram of a structure of the printed substrate 806. The respective signals and the power source voltage supplied to the interface 808 are supplied to the controller 801 and the power source circuit 802.

The controller 801 includes an A/D converter 809, a phase locked loop (PLL) 810, and a control signal generating portion 811. Besides, an SRAM (static random access memory) is provided in the case of performing digital drive. Note that, instead of the SRAM, an SDRAM may also be used, or a DRAM (dynamic random access memory) may also be used as long as writing and reading of data can be performed at high speed.

The video signals supplied through the interface 808 are subjected to parallel-serial conversion in the A/D converter 809, and the resultant signals, which serve as the video signals corresponding to the respective colors of R, G, and B, are inputted to the control signal generating portion 811. Further, an Hsync signal, Vsync signal, clock signal CLK, and an alternating voltage (AC Cont) are generated in the A/D converter 809 based on the respective signals supplied through the interface 808, and are inputted to the control signal generating portion 811.

The phase locked loop 810 has a function of adjusting a phase of a frequency of each of the signals supplied through the interface 808 to a phase of an operation frequency of the control signal generating portion 811. The operation frequency of the control signal generating portion 811 is not necessarily the same as the frequency of each of the signals supplied through the interface 808. Thus, the operation frequency of the control signal generating portion 811 is regulated in the phase locked loop 810 for synchronization of the above phases.

Note that the video signal input to the control signal generating portion 811 is once written to and held in the SRAM in the case of performing digital drive. In the control signal generating portion 811, the video signals corresponding to all the pixels are read out among the video signals of all the bits held in the SRAM on a bit-by-bit basis, and are supplied to the signal line driver circuit 805 of the panel 800.

Further, information of each bit on a period during which a light emitting element emits light is supplied from the control signal generating portion 811 to the scanning line driver circuit 804 of the panel 800.

Further, a predetermined power source voltage is supplied from the power source circuit 802 to the signal line driver circuit 805, the scanning line driver circuit 804, and the pixel portion 803 of the panel 800.

Next, a structure of the power source circuit 802 is described in detail with reference to FIG. 10. The power source circuit 802 in this embodiment is composed of a switching regulator 854 in which four switching regulator controls 860 are used and a series regulator 855.

In general, the switching regulator is small in size and light in weight compared with the series regulator, and can be used for not only drop in voltage but also rise in voltage and positive-negative inversion. On the contrary, the series regulator is used only for the drop in voltage. However, the series regulator is satisfactory in terms of precision in an output voltage compared with the switching regulator, and hardly involves the occurrence of ripple and noise. Both the regulators are used in combination in the power source circuit 802 in this embodiment.

Figure 10:
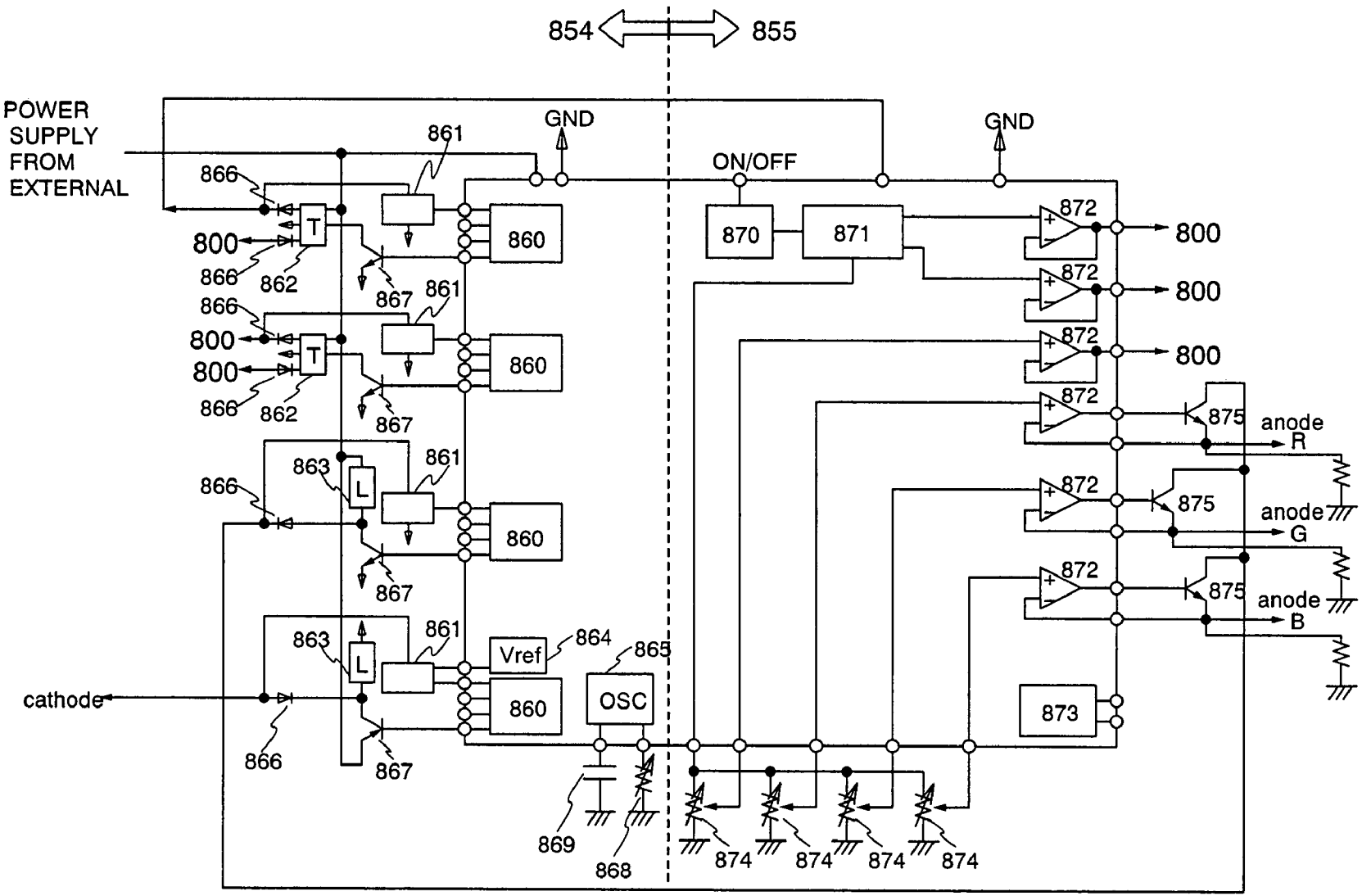
FIG. 10 is a diagram showing a power source circuit according to the present invention.
Figure 11:
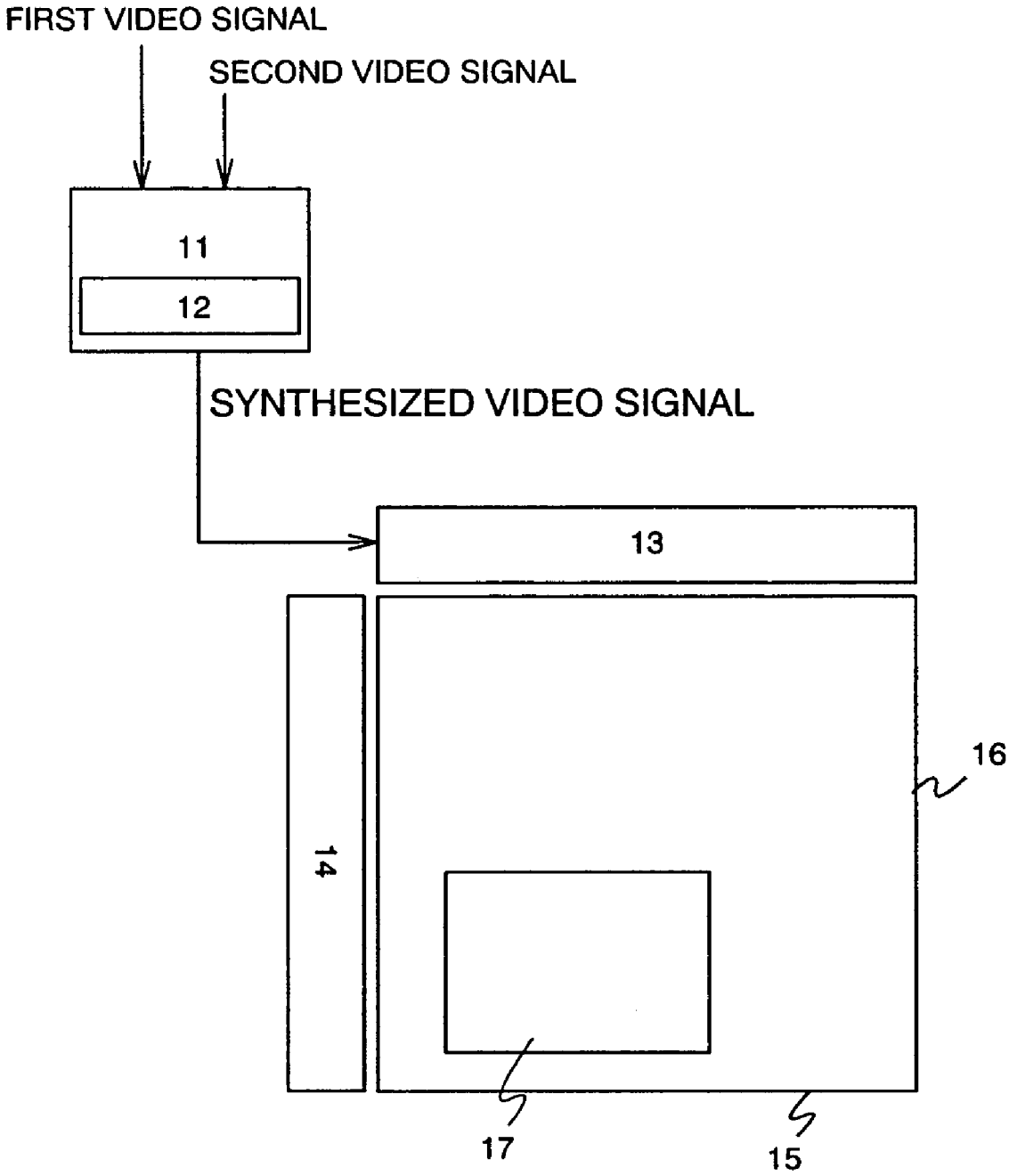
FIG. 11 is a diagram showing a conventional display device.

The switching regulator 854 in FIG. 10 includes the switching regulator controls (SWR) 860, attenuators (ATT) 861, transformers (T) 862, inductors (L) 863, a reference power source (Vref) 864, an oscillation circuit (OSC) 865, diodes 866, bipolar transistors 867, a variable resistor 868, and a capacitor 869.

A voltage of an external Li ion battery (3.6 V) or the like is converted in the switching regulator 854, whereby the power source voltage imparted to a cathode and the power source voltage to be supplied to the series regulator 855 are generated.

Further, the series regulator 855 includes a band gap circuit (BG) 870, an amplifier 871, operational amplifiers 872, a current source 873, variable resistors 874, and bipolar transistors 875. The power source voltage generated in the switching regulator 854 is supplied to the series regulator 855.

In the series regulator 855, a direct-current power source voltage, which is to be imparted to a wiring (current supply line) for supplying a current to an anode of a light emitting element for each color, is generated using the power source voltage generated in the switching regulator 854 on the basis of a constant voltage generated in the band gap circuit 870.

Note that the current source 873 is used for the case of a driving method in which a current serving as a video signal is written to a pixel. In this case, a current generated in the current source 873 is supplied to the signal line driver circuit 805 of the panel 800. Note that the current source 873 is not necessarily provided for the case of a driving method in which a voltage serving as a video signal is written to a pixel.

Note that the switching regulator, OSC, amplifier, and operational amplifier can be formed by using the above described manufacturing method.

With the structures as described above, in the multi-window display device, a load on an integrated circuit can be reduced since the video signals for plural screens do not need to be stored in the memory. Further, by providing the screen compression circuit in the panel, display can be arbitrarily performed without storing the image data on the relative position and the size of each screen in the memory for signal processing.

What is claimed is:

1. A display device capable of displaying a first screen and a second screen, and comprising a pixel comprising:

a display element;

a first signal line that inputs a signal for the first screen to the display element;

a first scanning line provided so as to intersect the first signal line;

a second signal line that inputs a signal for the second screen to the display element;

a second scanning line provided so as to intersect the second signal line;

means for selecting one of the first signal line and the second signal line; and a compression circuit that controls a size of one of the first screen and the second screen, wherein the compression circuit comprises plural first memories, a first control circuit that selects the first memory, plural second memories, and a second control circuit that selects the second memory, wherein one of the first memories which is selected by the first control circuit and one of the second memories which is selected by the second control circuit are brought into a conductive state, and wherein a signal is transferred from the first memory to the second memory in the conductive state, and the signal is inputted from the second memory to a pixel portion.

2. A display device according to claim 1, further comprising:

a pixel portion that includes the display element and is provided on the same substrate;

a signal line driver circuit portion that has: a first signal line driver circuit that controls the first signal line; a second signal line driver circuit that controls the second signal line; and the compression circuit;

a scanning line driver circuit portion that has a first scanning line driver circuit that controls the first scanning line and a second scanning line driver circuit that controls the second scanning line; and a printed substrate on which a controller connected with the substrate, an I/F, and a power source circuit are provided.

3. A display device capable of displaying a first screen and a second screen, comprising:

a display element;

a first signal line that inputs a signal for the first screen to the display element;

a first scanning line provided so as to intersect the first signal line;

a second signal line that inputs a signal for the second screen to the display element;

a second scanning line provided so as to intersect the second signal line;

a memory that holds information that selects one of the first signal line and the second signal line; and a compression circuit that controls a size of one of the first screen and the second screen, wherein the compression circuit comprises plural first memories, a first control circuit that selects the first memory, plural second memories, and a second control circuit that selects the second memory, wherein one of the first memories which is selected by the first control circuit and one of the second memories which is selected by the second control circuit are brought into a conductive state, and wherein a signal is transferred from the first memory to the second memory in the conductive state; and the signal is inputted from the second memory to a pixel portion.

4. A display device according to claim 3, further comprising:

a pixel portion that includes the display element and is provided on the same substrate;

a signal line driver circuit portion that has: a first signal line driver circuit that controls the first signal line; a second signal line driver circuit that controls the second signal line; and the compression circuit;

a scanning line driver circuit portion that has a first scanning line driver circuit that controls the first scanning line and a second scanning line driver circuit that controls the second scanning line; and a printed substrate on which a controller connected with the substrate, an I/F, and a power source circuit are provided.

5. A display device capable of displaying a first screen and a second screen, comprising:

a display element;

a first signal line that inputs a signal for the first screen to the display element, a first scanning line provided so as to intersect the first signal line;

a first transistor connected with the first signal line and the first scanning line;

a second signal line that inputs a signal for the second screen to the display element;

a second scanning line provided so as to intersect the second signal line;

a second transistor connected with the second signal line and the second scanning line;

a third transistor connected with the first transistor;

a fourth transistor that is connected with the second transistor and has a polarity different from that of the third transistor;

a third signal line connected to respective gate electrodes of the third transistor and the fourth transistor through a switch;

a third scanning line connected with the switch; and a compression circuit that controls a size of one of the first screen and the second screen, wherein the compression circuit comprises a plural of first memories, a first control circuit that selects the first memory, a plural of second memories, and a second control circuit that selects the second memory, wherein one of the first memories which is selected by the first control circuit and one of the second memories which is selected by the second control circuit are brought into a conductive state, and wherein a signal is transferred from the first memory to the second memory in the conductive state; and the signal is inputted from the second memory to a pixel portion.

6. A display device according to claim 5, further comprising:

a pixel portion that includes the display element and is provided on the same substrate;

a signal line driver circuit portion that has: a first signal line driver circuit that controls the first signal line; a second signal line driver circuit that controls the second signal line; and the compression circuit;

a scanning line driver circuit portion that has a first scanning line driver circuit that controls the first scanning line and a second scanning line driver circuit that controls the second scanning line; and a printed substrate on which a controller connected with the substrate, an I/F, and a power source circuit are provided.

7. A display device capable of displaying a first screen and a second screen, comprising:

a display element;

a first signal line that inputs a signal for the first screen to the display element;

a first scanning line provided so as to intersect the first signal line;

a first transistor connected with the first signal line and the first scanning line;

a second signal line that inputs a signal for the second screen to the display element;

a second scanning line provided so as to intersect the second signal line;

a second transistor connected with the second signal line and the second scanning line;

a third transistor connected with the first transistor;

a fourth transistor that is connected with the second transistor;

a latch circuit connected to the third transistor and the fourth transistor;

a third signal line connected to the latch circuit through a switch;

a third scanning line connected with the switch; and a compression circuit that controls a size of one of the first screen and the second screen, wherein the compression circuit comprises a plural of first memories, a first control circuit that selects the first memory, a plural of second memories, and a second control circuit that selects the second memory, wherein one of the first memories which is selected by the first control circuit and one of the second memories which is selected by the second control circuit are brought into a conductive state, and wherein a signal is transferred from the first memory to the second memory in the conductive state; and the signal is inputted from the second memory to a pixel portion.

8. A display device according to claim 7, further comprising:

a pixel portion that includes the display element and is provided on the same substrate;

a signal line driver circuit portion that has: a first signal line driver circuit that controls the first signal line; a second signal line driver circuit that controls the second signal line; and the compression circuit;

a scanning line driver circuit portion that has a first scanning line driver circuit that controls the first scanning line and a second scanning line driver circuit that controls the second scanning line; and a printed substrate on which a controller connected with the substrate, an I/F, and a power source circuit are provided.

* * * * *